US006942310B2

(12) United States Patent
Kanda et al.

(10) Patent No.: US 6,942,310 B2
(45) Date of Patent: Sep. 13, 2005

(54) INK-JET PRINTING METHOD AND APPARATUS

(75) Inventors: Hidehiko Kanda, Kanagawa (JP); Yoshinori Nakagawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 224 days.

(21) Appl. No.: 10/752,488

(22) Filed: Jan. 8, 2004

(65) Prior Publication Data

US 2004/0141020 A1 Jul. 22, 2004

Related U.S. Application Data

(62) Division of application No. 10/161,708, filed on Jun. 5, 2002, now Pat. No. 6,702,415.

(30) Foreign Application Priority Data

Jun. 7, 2001 (JP) ..... 2001-172740
May 28, 2002 (JP) ..... 2002-154462

(51) Int. Cl.[7] ..... B41J 2/205
(52) U.S. Cl. ..... 347/15; 347/41
(58) Field of Search ..... 347/15, 43, 41, 347/37, 16; 358/1.2, 1.9

(56) References Cited

U.S. PATENT DOCUMENTS 3,977,007 A * 8/1976 Berry et al. ..... 347/15
4,313,124 A 1/1982 Hara ..... 347/56
4,345,262 A 8/1982 Shirato et al. ..... 347/56
4,459,600 A 7/1984 Sato et al. ..... 347/56
4,463,359 A 7/1984 Ayata et al. ..... 347/56
4,558,333 A 12/1985 Sugitani et al. ..... 347/65
4,608,577 A 8/1986 Hori ..... 347/66
4,723,129 A 2/1988 Endo et al. ..... 347/56
4,740,796 A 4/1988 Endo et al. ..... 347/10
5,696,542 A 12/1997 Matsubara et al. ..... 347/12
5,798,776 A 8/1998 Uchiyama et al. ..... 347/43
5,844,582 A * 12/1998 Shioya ..... 347/15
5,844,583 A * 12/1998 Onishi et al. ..... 347/16
6,328,404 B1 12/2001 Fujimori ..... 347/15

FOREIGN PATENT DOCUMENTS

JP 54-56847 5/1979
JP 59-123670 7/1984
JP 59-138461 8/1984
JP 60-71260 4/1985
JP 6-143618 5/1994

* cited by examiner

*Primary Examiner*—Lamson Nguyen
(74) *Attorney, Agent, or Firm*—Fitzpatrick, Cella, Harper & Scinto

(57) ABSTRACT

Printing is performed on a printing medium by using an ink-jet printhead for discharging ink, multilevel printing is performed by multipass printing operation of executing main scanning operation of moving the printhead relative to the printing medium with respect to each print area while changing the number of ink droplets discharged to each pixel, and the number of scans to be performed to discharge ink droplets used to print a pixel with a low gray level value is made larger than the number of scans to be performed to discharge ink droplets used only to print a pixel with a high gray level value, thereby preventing the occurrence of density irregularity and streaks in a low gray level portion and printing a high-quality image.

14 Claims, 27 Drawing Sheets

| | QUANTIZATION LEVEL | PIXEL PATTERN |
|---|---|---|
| (A) | 0 | |
| (B) | 1 | |
| (C) | 2 | |
| (D) | 3 | |

SCANNING DIRECTION OF PRINTHEAD (MAIN SCANNING DIRECTION)
FIRST SCAN
SECOND SCAN
THIRD SCAN
FOURTH SCAN
FIFTH SCAN
SIXTH SCAN
SEVENTH SCAN
EIGHTH SCAN
4.5 NOZZLE / 600dpi
3.5 NOZZLE / 600dpi
4.5 NOZZLE / 600dpi
3.5 NOZZLE / 600dpi
4.5 NOZZLE / 600dpi
4 NOZZLE / 600dpi
4 NOZZLE / 600dpi
3.5 NOZZLE / 600dpi
n32
n28
n25
n24
n20
n17
n16
n12
n8
n4
n1
(a)
(b)
(a)+(b)
(a)
(b)+(a)
(a)+(b)+(a)
(b)+(a)+(b)
(a)+(b)+(a)+(b)

| | QUANTIZATION LEVEL | PIXEL PATTERN |
|---|---|---|
| (A) | 0 | |
| (B) | 1 | |
| (C) | 1 | |
| (D) | 2 | |
| (E) | 3 | |

FIG. 16

| SCAN COUNT | CONVEY AMOUNT (INCH) | NOZZLES USED | DOT POSITION | MASK PATTERN | SCANNING DIRECTION |
|---|---|---|---|---|---|
| 1 | 4.5/600 | 29~32 | a | a1 | FORWARD |
| 2 | 3.5/600 | 25~32 | b | b1 | FORWARD |
| 3 | 4.5/600 | 21~32 | a | a2 | FORWARD |
| 4 | 3.5/600 | 17~32 | b | b2 | FORWARD |
| 5 | 4.5/600 | 13~32 | a | a3 | FORWARD |
| 6 | 4/600 | 9~32 | c | c | FORWARD |
| 7 | 4/600 | 5~32 | a | a4 | FORWARD |
| 8 | 3.5/600 | 1~32 | d | c | FORWARD |

FIG. 17

| SCAN COUNT | CONVEY AMOUNT (INCH) | NOZZLES USED | DOT POSITION | MASK PATTERN | SCANNING DIRECTION |
|---|---|---|---|---|---|
| 1 | 4.5/600 | 29~32 | a | a1 | FORWARD |
| 2 | 3.5/600 | 25~32 | b | b1 | BACKWARD |
| 3 | 4.5/600 | 21~32 | a | a2 | FORWARD |
| 4 | 3.5/600 | 17~32 | b | b2 | BACKWARD |
| 5 | 4.5/600 | 13~32 | a | a3 | FORWARD |
| 6 | 4/600 | 9~32 | c | c | BACKWARD |
| 7 | 4/600 | 5~32 | a | a4 | FORWARD |
| 8 | 3.5/600 | 1~32 | d | c | BACKWARD |

FIG. 18

| SCAN COUNT | CONVEY AMOUNT (INCH) | NOZZLES USED | DOT POSITION | MASK PATTERN | SCANNING DIRECTION |
|---|---|---|---|---|---|
| 1 | 4.5/600 | 29~32 | a | a1 | FORWARD |
| 2 | 3.5/600 | 25~32 | b | a1 | FORWARD |
| 3 | 4.5/600 | 21~32 | a | a2 | FORWARD |
| 4 | 3.5/600 | 17~32 | b | a2 | FORWARD |
| 5 | 4.5/600 | 13~32 | a | a3 | FORWARD |
| 6 | 3.5/600 | 9~32 | b | a3 | FORWARD |
| 7 | 4.5/600 | 5~32 | c | c | FORWARD |
| 8 | 3.5/600 | 1~32 | d | c | FORWARD |

FIG. 19

| SCAN COUNT | CONVEY AMOUNT (INCH) | NOZZLES USED | DOT POSITION | MASK PATTERN | SCANNING DIRECTION |
|---|---|---|---|---|---|
| 1 | 4.5/600 | 29~32 | a | a1 | FORWARD |
| 2 | 3.5/600 | 25~32 | b | b1 | BACKWARD |
| 3 | 4.5/600 | 21~32 | a | a2 | FORWARD |
| 4 | 4/600 | 17~32 | c | c | BACKWARD |
| 5 | 4/600 | 13~32 | a | a3 | FORWARD |
| 6 | 3.5/600 | 9~32 | b | b2 | BACKWARD |
| 7 | 4.5/600 | 5~32 | a | a4 | FORWARD |
| 8 | 3.5/600 | 1~32 | d | c | BACKWARD |

| | QUANTIZATION LEVEL | PIXEL PATTERN |
|---|---|---|
| (A) | 0 | |
| (B) | 1 | |
| (C) | 1 | |
| (D) | 2 | |
| (E) | 3 | |

| | QUANTIZATION LEVEL | PIXEL PATTERN |
|---|---|---|
| (A) | 0 | |
| (B) | 1 | |
| (C) | 2 | |
| (D) | 3 | |

| | QUANTIZATION LEVEL | PIXEL PATTERN |
|---|---|---|
| (A) | 0 | |
| (B) | 1 | |
| (C) | 2 | |
| (D) | 3 | |
| (E) | 3 | |

INK-JET PRINTING METHOD AND APPARATUS

This application is a divisional of application Ser. No. 10/161,708, filed Jun. 5, 2002, now U.S. Pat. No. 6,702,415.

FIELD OF THE INVENTION

The present invention relates to an ink-jet printing method and apparatus and, more particularly, to an ink-jet printing method and apparatus configured to perform multilevel printing by landing the number of ink droplets corresponding to a gray level value onto each pixel in printing on a printing medium while performing main scanning operation of moving an ink-jet printhead for discharging ink relative to the printing medium.

BACKGROUND OF THE INVENTION

A printing apparatus serving as a printer, copying machine, facsimile apparatus or the like or a printing apparatus used as an output device for a composite electronic device or workstation such as a computer or wordprocessor is designed to print on a printing medium such as a thin plastic plate on the basis of image information including character information and the like.

Such printing apparatuses can be classified into the ink-jet type, wire-dot type, thermal type, laser beam type, and the like. Of the above printing apparatuses, an ink-jet type printing apparatus (ink-jet printing apparatus) is designed to print by discharging ink from a printing means such as a printhead onto a printing medium, and has the following advantages as compared with the other printing schemes. This printing apparatus allows an easy increase in resolution, can operate at high speed, and is very quiet. In addition, the printing apparatus is low in cost.

The need for color prints has increased, and many color ink-jet printing apparatuses have been developed. A general ink-jet printing apparatus uses a printhead formed by integrating pluralities of orifices and liquid channels as ink discharging portions as a printhead formed by integrating an array of a plurality of printing elements in order to attain an increase in printing speed. In addition, in order to realize color printing, such an ink-jet printing apparatus generally has a plurality of printheads.

FIG. 1 is a view showing the schematic arrangement of a general printer portion based on the scheme of printing by scanning a printhead on a printing sheet P. Referring to FIG. 1, reference numeral 101 denotes an ink cartridge. These ink cartridges are constituted by ink tanks respectively storing four color inks, i.e., black, cyan, magenta, and yellow inks, and identical printheads 102 provided for the respective inks.

FIG. 2 is a view showing the orifices formed in each printhead when viewed from the z direction. As shown in FIG. 2, a plurality of orifices 201 are arranged at predetermined intervals on the printhead 102.

Referring back to FIG. 1, reference numeral 103 denotes a convey roller for a printing medium, which rotates in the direction indicated by the arrow in FIG. 1 while holding a paper sheet P, together with an auxiliary roller 104 and sequentially feeds the paper sheet P in the y direction; 105, feed rollers for feeding a printing sheet and also holding the paper sheet P like the rollers 103 and 104; and 106, a carriage which supports the four ink cartridges 101 and moves/scans them in printing operation. These ink cartridges are set in the standby state at the home position (h) indicated by the dotted line in FIG. 1 while no printing is performed, or recovery operation is done for the printheads.

Before printing operation, when receiving a printing start instruction, the carriage 106 at the home position h in FIG. 1 discharges ink from a plurality of orifices 201 on the printhead 102 while moving in the x direction, thereby printing data. When data is completely printed up to an end portion of a printing sheet surface, the carriage 106 returns to the home position, and prints in the x direction again.

When an image or the like is to be printed, various factors need to be considered including color development characteristics, gray level characteristics, uniformity, and the like. With regard to uniformity, in particular, it is known that slight variations caused on a nozzle basis in a printhead manufacturing process will influence the amount of ink discharged from each nozzle and the discharge direction, resulting in a deterioration in image quality which appears as density irregularity of a printed image.

A specific example of this will be described with reference to FIGS. 3A to 3C and 4A to 4C. Referring to FIG. 3A, reference numeral 31 denotes a printhead constituted by eight nozzles 32; and 33, an ink droplet discharged from the nozzle 32. In general, it is ideal that ink is discharged with a uniform discharge amount in a uniform direction. If ink is discharged in this manner, dots with a uniform size land on a paper sheet as shown in FIG. 3B, and a uniform image without any density irregularity can be obtained as a whole (FIG. 3C).

In practice, however, each nozzle varies, as described above. If, therefore, printing is done in the above manner without any change, ink droplets discharged from the respective nozzles vary in size and direction as shown in FIG. 4A and land on a sheet surface in the manner shown in FIG. 4B. Referring to FIG. 4B, blank portions in each of which the area factor cannot be satisfied 100% periodically exist in the head main scanning direction, dots are excessively superimposed in some portions, and white streaks are produced as indicated at a central portion of this drawing.

A set of dots landed in this state exhibits the density distribution shown in FIG. 4C in the nozzle array direction. As a consequence, these phenomena are generally perceived as density irregularity by the human eye. In addition, if the convey amount of the printing medium varies, the resultant streaks may become noticeable.

As a countermeasure against density irregularity, the following method is disclosed in Japanese Patent Laid-Open No. 06-143618. This method will be briefly described with reference to FIGS. 4A to 4C and FIGS. 5A to 5C. According to this method, the printhead 31 is scanned three times in the main scanning direction (FIG. 5A) to complete the print area shown in FIG. 5B. A four-pixel area corresponding to ½ each print area is completed by two passes. In this case, the eight nozzles of the printhead are formed into two groups, i.e., four upper nozzles and four lower nozzles. The dot printed by one nozzle upon one main scanning operation corresponds to the data obtained by thinning out specified image data to about ½ in accordance with a predetermined image data arrangement (mask pattern). In the second main scanning operation, dots are formed in accordance with the remaining half image data to completely print a four-pixel area. The above printing method will be referred to as a multipass printing method hereinafter.

With the use of such a printing method, even if a printhead like the one shown in FIG. 4A is used, since the influences of the variations unique to the respective nozzles on a printed image are reduced to ½, an image similar to the one shown in FIG. 5B is printed. As a result, black and white streaks like those shown in FIG. 4B become less noticeable. As shown in FIG. 5C, the density irregularity is considerably reduced as compared with the case shown in FIG. 4C.

In such multipass printing, image data is divided into complementary data to be used in the first and second main scanning operations according to predetermined mask patterns. In most instances, patterns like staggered patterns in which pixels are vertically and horizontally staggered pixel by pixel as shown in FIGS. 6A to 6C are used as such mask patterns. In a unit print area (four-pixel area in this case), printing is completed by the first main scanning operation of printing a staggered pattern and the second main scanning operation of printing an inverse staggered pattern.

FIGS. 6A, 6B, and 6C show how printing in a predetermined area is done by using these staggered and inverse staggered mask patterns. First of all, in the first main scanning operation, printing is performed by using the four lower nozzles and the staggered mask pattern (FIG. 6A). In the second main scanning operation, the printing medium is conveyed by four pixels (½ the head length), and printing is performed by using the inverse staggered mask pattern (FIG. 6B). In the third main scanning operation, the printing medium is conveyed by four pixels (½ the head length), and printing is performed by using the staggered mask pattern again (FIG. 6C). In this manner, the printing medium is sequentially conveyed by four pixels at a time, and printing operations using the staggered and inverse staggered mask patterns are alternately performed to complete a four-pixel print area in each main scanning operation.

As described above, by completing an image in each print area using two different sets of nozzles, a high-quality image without density irregularity can be obtained.

There has recently been an increasing demand for an improvement in image quality in printing apparatuses. In order to meet this demand, attempts have been made to increase the resolution of printing apparatuses. If, however, the resolution of a printing apparatus is increased, the number of pixels increases, resulting in an increase in the amount of image data. This prolongs the data processing time in a host computer (host unit), the transfer time of data from the host computer to the printing apparatus, and the like.

The conventionally known matrix printing method is designed to solve such a problem. In this method, the image data processed in a host computer with a relatively low resolution by using many quantization levels (gray levels) is transferred to a printing apparatus, and printing is performed upon converting the received image data into print data corresponding to a predetermined dot matrix on the printing apparatus side. According to this method, even if the data amount is reduced, a gray level expression equivalent to the print result obtained by high-resolution processing can be realized.

In printing multilevel image data by multipass printing, an image is completed by scanning all areas (areas with different gray levels) the same number of times regardless of the quantization level (gray level) of the image data. However, the actual numbers of scans used to print at the respective gray levels differ from each other; the number of scans performed to actually print a low gray level portion, in particular, is small. That is, all the areas (areas with different gray levels) are scanned by the number of times (predetermined number of times) required to print a high gray level portion. However, the number of scans performed to actually print a low gray level portion is smaller than the predetermined number of times.

More specifically, when grayscale image data quantized with four quantization levels is to be printed by multipass printing with four passes, four scans are performed with respect to areas corresponding to the respective gray levels (level 1 to level 4). However, the numbers of scans performed to actually print the areas corresponding to the respective gray levels differ according to the levels. Data with level 1 is printed by one scan; data with level 2, by two scans; data with level 3, by three scans; and data with level 4, by four scans.

In this manner, proper printing with density irregularity and streaks being sufficiently reduced is done in a high gray level portion with a high quantization level, which rarely occurs in a natural image and the like, because printing is done by a relatively large number of scans. On the other hand, the same number of scans as in a high gray level portion with a high quantization level are also performed in a low gray level portion with a low quantization level which appears especially often in a natural image and the like. However, the number of scans used for actual printing is small, and hence unnecessary scans that actually print nothing are performed. More specifically, even if the same number (predetermined number) of scans as that for a high gray level portion are performed with respect to a low gray level portion, some of the predetermined number of scans are performed to actually print nothing. Since the number of scans that actually contribute to printing of a low gray level portion is small, the effect of multipass printing cannot be sufficiently obtained, and density irregularity and streaks tend to occur in a low gray level portion. This poses a problem (first problem).

Another problem is that in printing by assigning pixel patterns (dot matrixes) like those shown in FIG. 20 to the respective gray levels, when matrixes (pixel patterns) having different dot arrangements are assigned to the same low gray level (gray level 1), the intervals between the dots constituting a low gray level portion vary, resulting in graininess (noise).

This problem will be described by taking a specific example. Assume that dot matrixes (pixel patterns) each obtained by dividing a pixel into 2 (vertical)×1 (horizontal) portions are respectively assigned to gray level image data quantized with four values from level 0 to level 3 corresponding to the numbers of ink droplets, i.e., 0, 1, 2, and 4, to land within a pixel as shown in FIG. 20. In this case, data with quantization level 1 is assigned one of two kinds of dot matrixes, i.e., a dot matrix (the matrix indicated by "(B)" in FIG. 20) in which only one dot is placed on the left side and a dot matrix (the matrix indicated by "(C)" in FIG. 20) in which only one dot is placed on the right side. Data with quantization level 2 is assigned a dot matrix (the matrix indicated by "(D)" in FIG. 20) in which one dot is placed on each of the left and right sides. Data with quantization level 3 is assigned a dot matrix (the matrix indicated by "(E)" in FIG. 20) in which two dots are placed on each of the left and right sides.

FIG. 21A shows an image (low gray level portion) in which two kinds of dot matrixes corresponding to quantization level 1 are alternately arranged. As is obvious from FIG. 21A, the dot density is low ("coarse") in a portion where a dot matrix (the matrix indicated by "(C)" in FIG. 20) in which only one dot exists on the right side is placed on the right of a dot matrix (the matrix indicated by "(B)" in FIG. 20) in which only one dot is placed on the left side. The dot density is high ("dense") in a portion where a dot matrix (the matrix indicated by "(B)" in FIG. 20) in which only one dot is placed on the right side exists on the right of a dot matrix (the matrix indicated by "(C)" in FIG. 20) in which only one dot is placed on the left side. If coarse and dense portions are produced in this manner, the resultant image has graininess (noise). FIG. 21B shows an image (low gray level portion) constituted by two kinds of dot matrix patterns corresponding to quantization level 1 and one kind of dot matrix corresponding to quantization level 2. As is obvious from FIG. 21B, the dot density is low ("coarse") in a portion where a dot matrix corresponding to quantization level 2 (the dot matrix indicated by "(D)" in FIG. 20) in which one dot is placed on each of the left and right sides exists on the right of a dot matrix corresponding to quantization level 1 (the matrix indicated by "(B)" in FIG. 20) in which one dot is placed on the left side. The dot density is high ("dense") in a portion where a dot matrix corresponding to quantization level 2 (the dot matrix indicated by "(D)" in FIG. 20) in which one dot is placed on each of the left and right sides exists on the right of a dot matrix corresponding to quantization level 1 (the matrix indicated by "(C)" in FIG. 20) in which one dot is placed on the right side. In this case, as in the case shown in FIG. 21A, the production of coarse and dense portion leads to graininess (noise).

As described above, if a low gray level portion with a low quantization level which appears especially often in a natural image or the like is printed by using dot matrixes (pixel patterns) having different dot arrangements, the intervals between dots vary. This tends to cause graininess (noise). This poses a problem (second problem).

SUMMARY OF THE INVENTION

The present invention has been made in consideration of the first problem, and has as its object to provide an ink-jet printing method and apparatus which can print a high-quality image by sufficiently suppressing the occurrence of density irregularity and streaks in a low gray level portion.

According to the present invention, the foregoing object is attained by providing an ink-jet printing method of performing a plurality of main scanning operations of an ink-jet printhead for discharging ink with respect to the same print area and completing printing on the same print area by the plurality of main scanning operations, comprising the printing step of performing multilevel printing by changing the number of ink droplets discharged to each pixel in the plurality of main scanning operations, wherein in the printing step, multilevel printing is performed such that the number of scans performed to discharge ink droplets used to print a pixel with a low gray level value is made larger than the number of scans performed to discharge ink droplets used only to print a pixel with a high gray level value.

According to the present invention, the foregoing object is attained by providing a program for causing a computer to execute processing of controlling the number of main scanning operations performed in an ink-jet printing method of performing a plurality of main scanning operations of an ink-jet printhead for discharging ink with respect to the same print area and completing printing on the same print area by the plurality of main scanning operations, the program including a code for the step of controlling the number of main scanning operations in performing multilevel printing by changing the number of ink droplets discharged to each pixel such that the number of scans performed to discharge ink droplets used to print a pixel with a low gray level value is made larger than the number of scans performed to discharge ink droplets used only to print a pixel with a high gray level value.

According to the present invention, the foregoing object is attained by providing a storage medium for storing the above described program.

According to the present invention, the foregoing object is attained by providing an ink-jet printing apparatus for performing a plurality of main scanning operations of an ink-jet printhead for discharging ink with respect to the same print area and completing printing on the same print area by the plurality of main scanning operations, comprising control means for controlling the number of main scanning operations in performing multilevel printing by changing the number of ink droplets discharged to each pixel such that the number of scans performed to discharge ink droplets used to print a pixel with a low gray level value is made larger than the number of scans performed to discharge ink droplets used only to print a pixel with a high gray level value.

That is, according to the present invention, multilevel printing is performed by changing the number of ink droplets to be discharged onto each pixel using a multipass printing scheme of scanning the printhead over the same print area on a printing medium a plural number of times in the main scanning direction and completing printing operation with respect to the same print area by the plural number of main scanning operations. The numbers of main scanning operations in this multilevel printing are set such that the number of scans performed to discharge ink droplets used to print a pixel with a low gray level value is larger than the number of scans performed to discharge ink droplets used only to print a pixel with a high gray level value.

With this operation, in printing a low gray level portion including many pixels with low gray level values, ink droplets constituting adjacent pixels are printed with different discharge characteristics. This makes it possible to prevent the occurrence of density irregularity and streaks which are especially noticeable in a low gray level portion.

Note that ink droplets used to print a pixel with a low gray level value may also be used to print a pixel with a high gray level value.

In addition, the number of scans performed to discharge ink droplets used to print a pixel with a low gray level value may be set to be larger than the number of scans performed to discharge ink droplets used only to print a pixel with a high gray level value.

Furthermore, different mask patterns may be used in the respective scans performed to discharge ink droplets used to print pixels with low gray level values.

In this case, the mask patterns used in the respective scans are preferably complementary to each other such that the sum of the ratios of the areas printed with all the mask patterns becomes 100%.

In addition, scans performed to discharge ink droplets used only to print a pixel with a high gray level value is preferably controlled to be performed at almost equal intervals in each scan.

In addition, a scan performed to discharge ink droplets used to print a pixel with a low gray level value and a scan performed to discharge ink droplets used only to print a pixel with a high gray level value are preferably controlled to be performed in different directions.

In this case, a scan performed to discharge ink droplets used to print a pixel with a low gray level value and a scan performed to discharge ink droplets used only to print a pixel with a high gray level value are preferably controlled to be alternately performed.

In addition, multilevel printing may be performed by dividing each pixel into a predetermined number of areas and using a pattern for designating an area to which an ink droplet is to be discharged in accordance with each gray level value.

In this case, a plurality of patterns may be used for the same gray level value.

In addition, the printhead may have a plurality of printing elements for discharging ink, and the above main scanning operation may be performed by moving the carriage, on which the printhead is mounted, on the printing medium.

Preferably, the printhead is a printhead for discharging ink by using heat energy, and has a heat energy converter for generating heat energy applied to the ink.

The present invention has been made in consideration of the second problem, and has as its object to provide an ink-jet printing method and apparatus which can form a high-quality image by reducing graininess (noise) in low gray level portion. It is another object of the present invention to provide an ink-jet printing method and apparatus which set a sufficient density in a high gray level portion as well as reducing graininess (noise) in a low gray level portion.

According to the present invention, the foregoing object is attained by providing an ink-jet printing method of discharging ink to each pixel on a printing medium while performing main scanning operation of an ink-jet printhead for discharging ink relative to the printing medium, and performing gray level printing by landing the number of ink dots corresponding to a gray level value on each pixel, comprising the printing step of printing pixels belonging to a first gray level value group corresponding to at least the lowest and second lowest gray level values, of a plurality of gray level values from which a gray level value with which the dot is not printed is excluded, such that dot landing positions or dot barycenters in the pixels become the same, and printing pixels belonging to a second gray level value group corresponding to a gray level value higher than that of the first gray level value group such that dot landing positions in the pixels become not less than two positions.

According to the present invention, the foregoing object is attained by providing an ink-jet printing apparatus for discharging ink to each pixel on a printing medium while performing main scanning operation of an ink-jet printhead for discharging ink relative to the printing medium, and performing gray level printing by landing the number of ink dots corresponding to a gray level value on each pixel, comprising printing control means for printing pixels belonging to a first gray level value group corresponding to at least the lowest and second lowest gray level values, of a plurality of gray level values from which a gray level value with which the dot is not printed is excluded, such that dot landing positions or dot barycenters in the pixels become the same, and printing pixels belonging to a second gray level value group corresponding to a gray level value higher than that of the first gray level value group such that dot landing positions in the pixels become not less than two positions.

According to this arrangement, pixels belonging to "the first gray level value group" corresponding to at least the lowest or second lowest gray level value are printed such that the dot landing positions or dot barycenters in the pixels become the same. This makes it possible to form a low gray level portion with reduced graininess (noise). In addition, pixels belonging to "the second gray level value group" corresponding to a gray level value higher than that of the first gray level value group are printed such that dots land at two or more different positions in each pixel. This makes it possible to form a high gray level portion having a sufficient density while a sufficient area factor can be ensured.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 16 is a view showing a list of printing parameters for each scan in the first embodiment;

FIG. 17 is a view showing a list of printing parameters for each scan in the second embodiment;

FIG. 18 is a view showing a list of printing parameters for each scan in the third embodiment;

FIG. 19 is a view showing a list of printing parameters for each scan in the fourth embodiment;

DETAILED DESCRIPTION OF THE PREFERRED EMBODIMENTS

Preferred embodiments of the present invention will now be described in detail in accordance with the accompanying drawings.

In this specification, "print" is not only to form significant information such as characters and graphics, but also to form, e.g., images, figures, and patterns on printing media in a broad sense, regardless of whether the information formed is significant or insignificant or whether the information formed is visualized so that a human can visually perceive it, or to process printing media.

"Print media" are any media capable of receiving ink, such as cloth, plastic films, metal plates, glass, ceramics, wood, and leather, as well as paper sheets used in common printing apparatuses.

Furthermore, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

[Overall Arrangement of Printing Apparatus]

Figure 1:
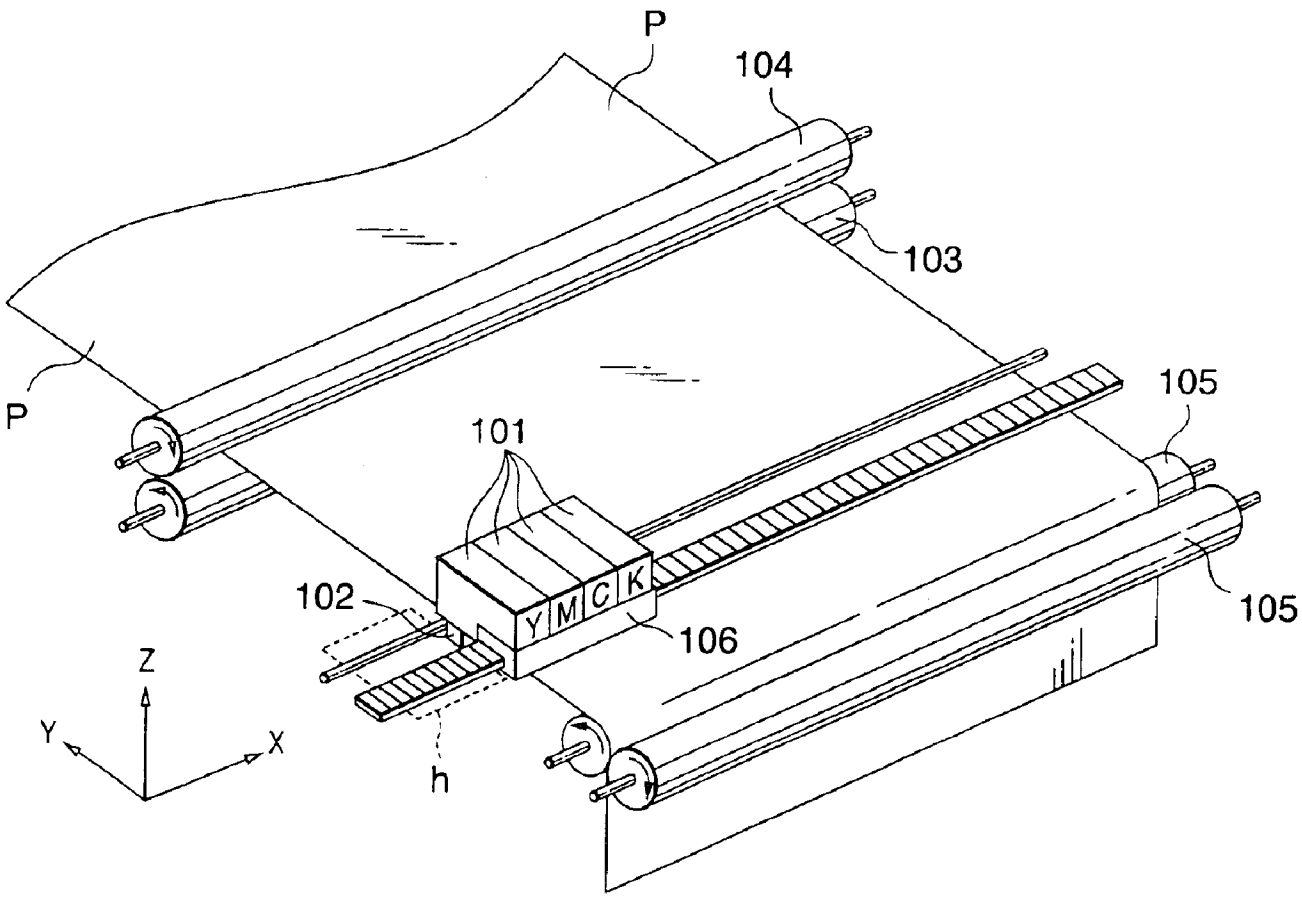
FIG. 1 is a perspective view showing the schematic arrangement of a general ink-jet printing apparatus.
Figure 2:
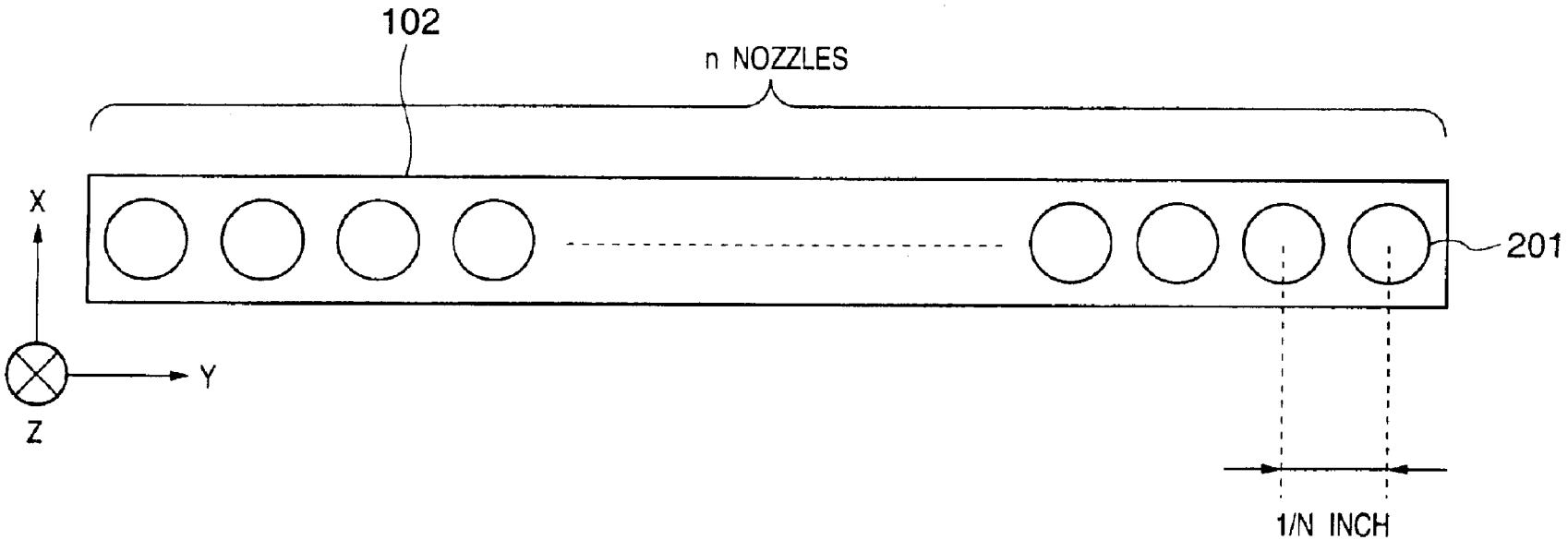
FIG. 2 is a view schematically showing the nozzle array of a printhead.
Figure 3C:
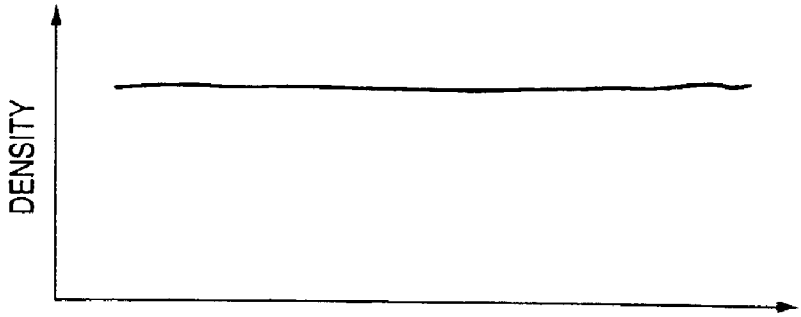
FIGS. 3A to 3C are views for explaining an ideal printing state in the ink-jet printing apparatus.
Figure 3B:
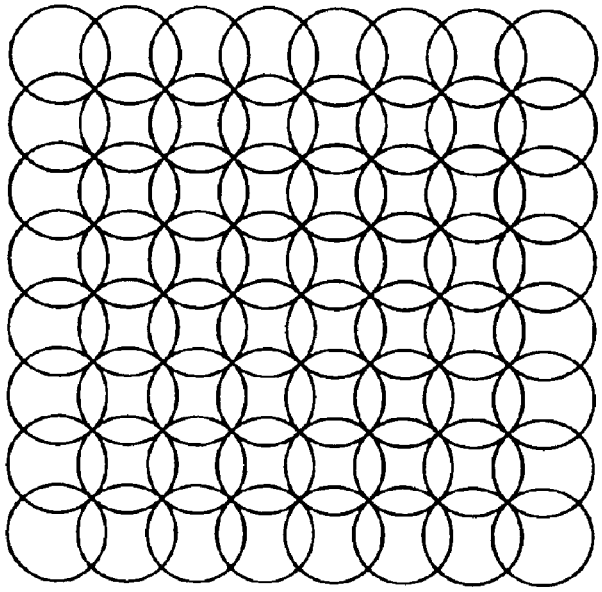
Figure 3A:
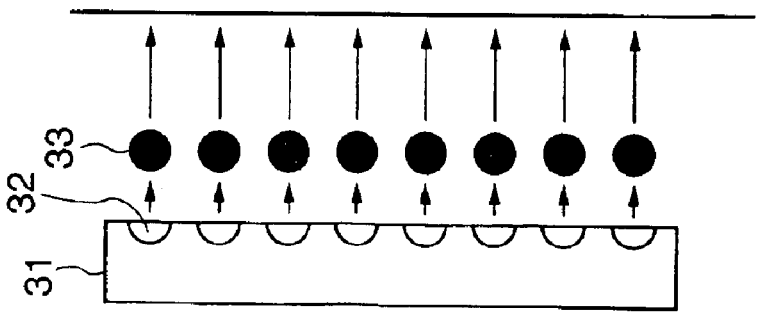
Figure 4C:
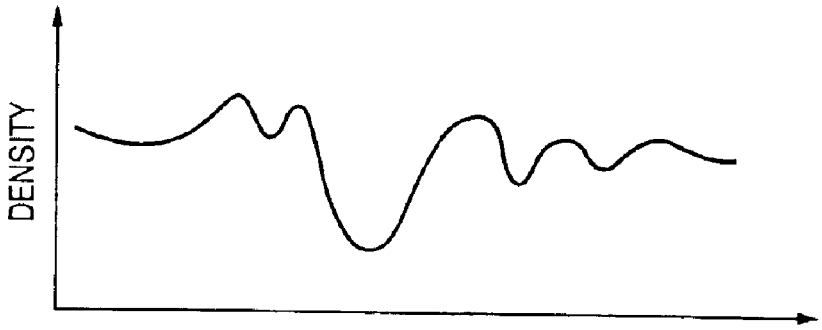
FIGS. 4A to 4C are views showing a printing state wherein density irregularity occurs in the ink-jet printing apparatus.
Figure 4B:
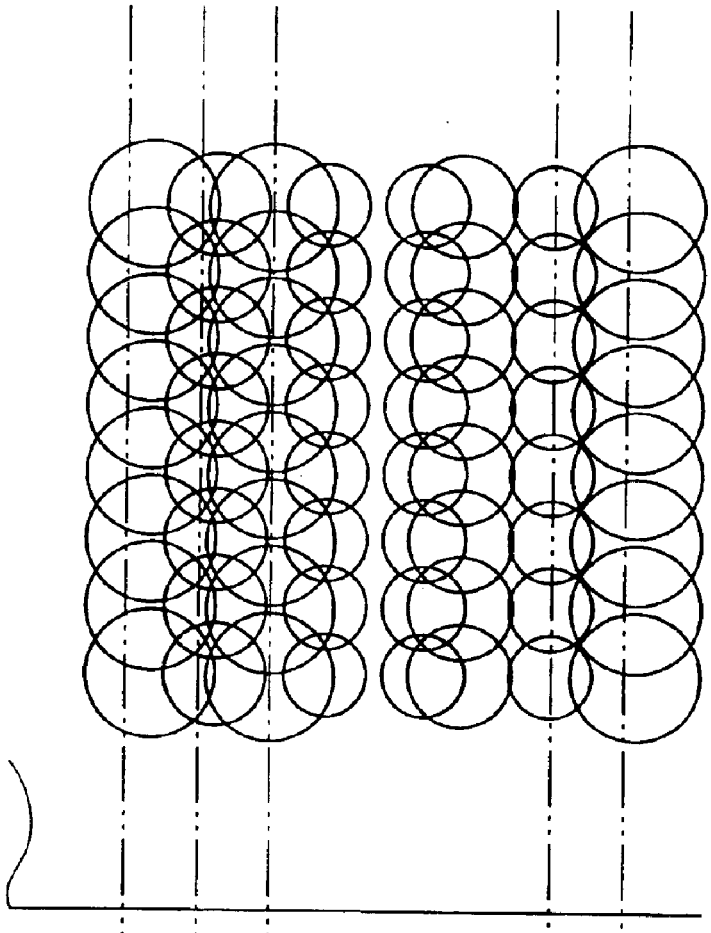
Figure 4A:
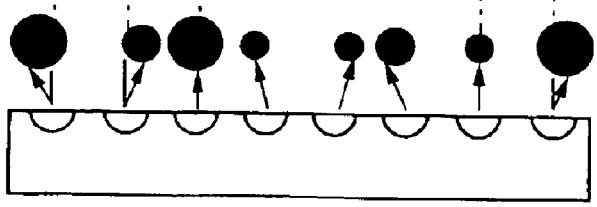
Figure 5A:
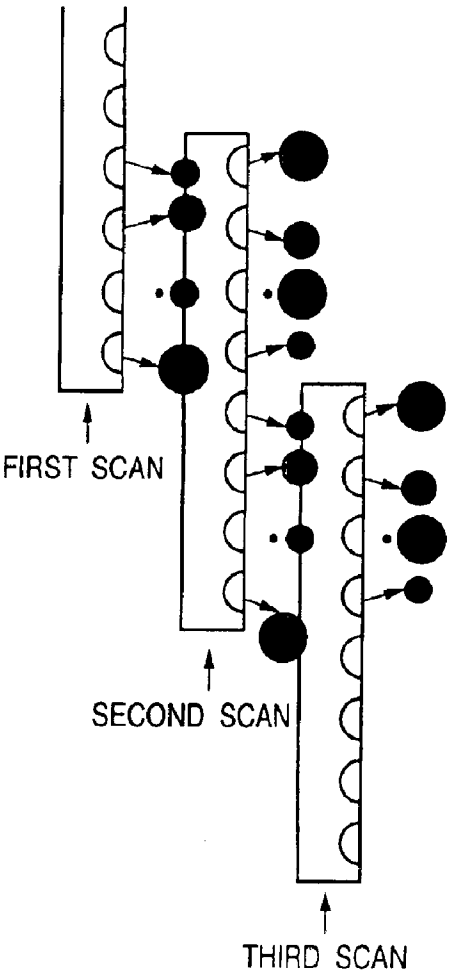
FIGS. 5A to 5C are views for explaining a printing state based on a multipass printing method.
Figure 5B:
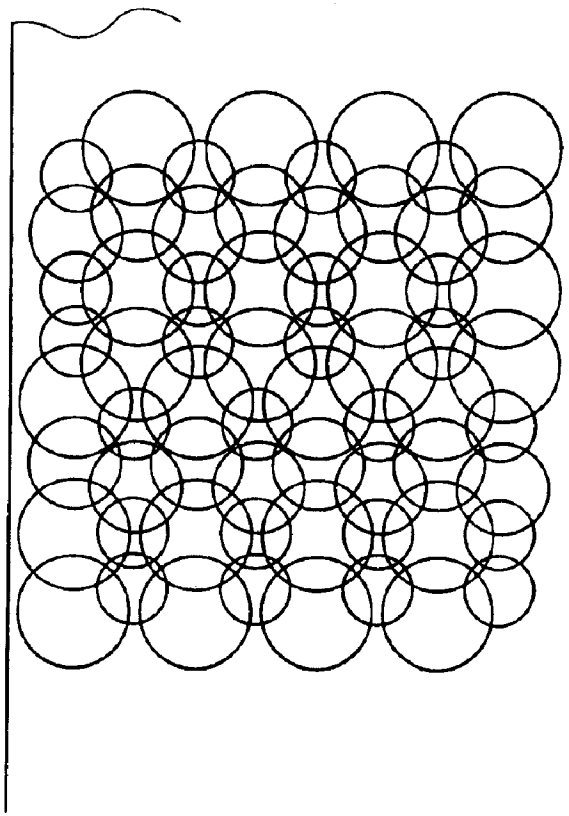
Figure 5C:
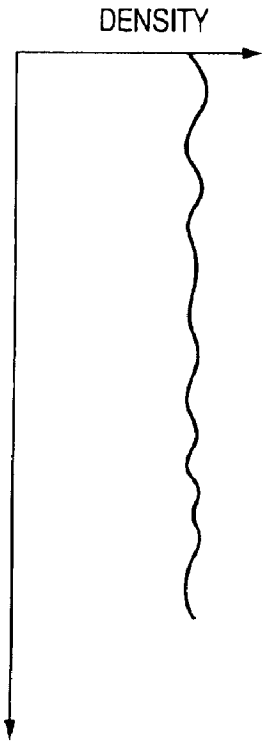
Figure 6A:
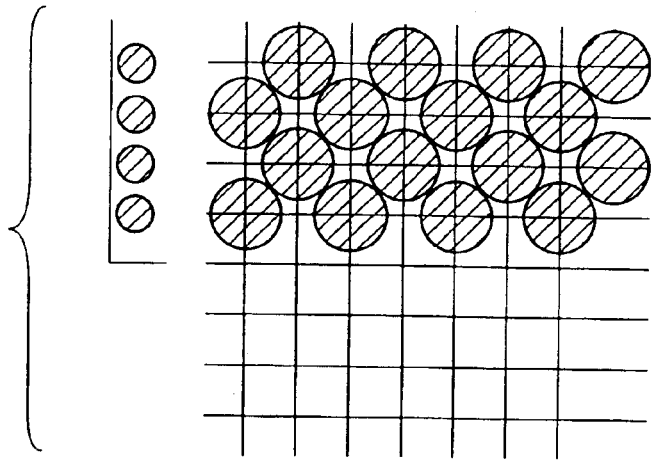
FIGS. 6A to 6C are views for explaining examples of mask patterns used in the multipass printing method.
Figure 6B:
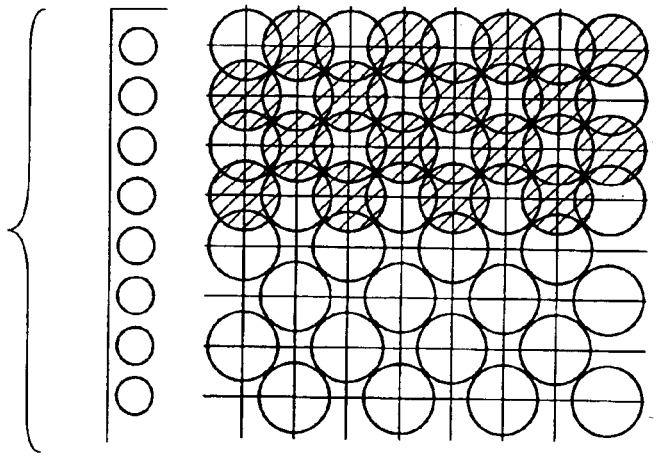
Figure 6C:
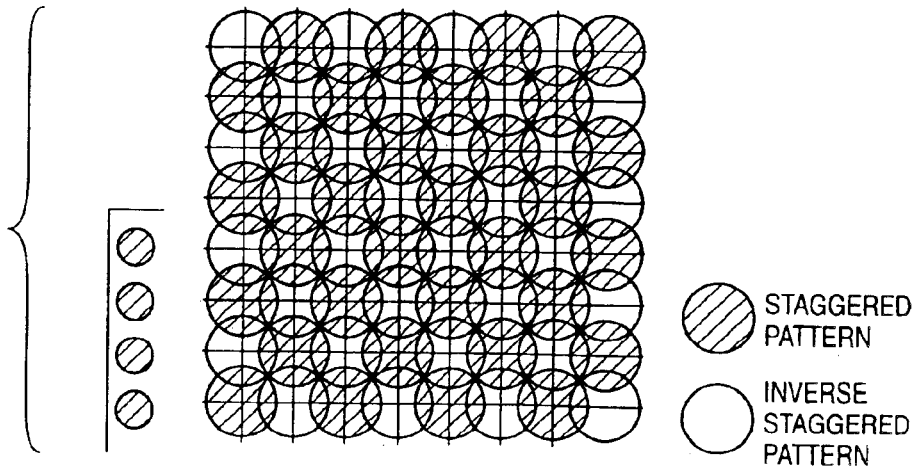
Figure 7:
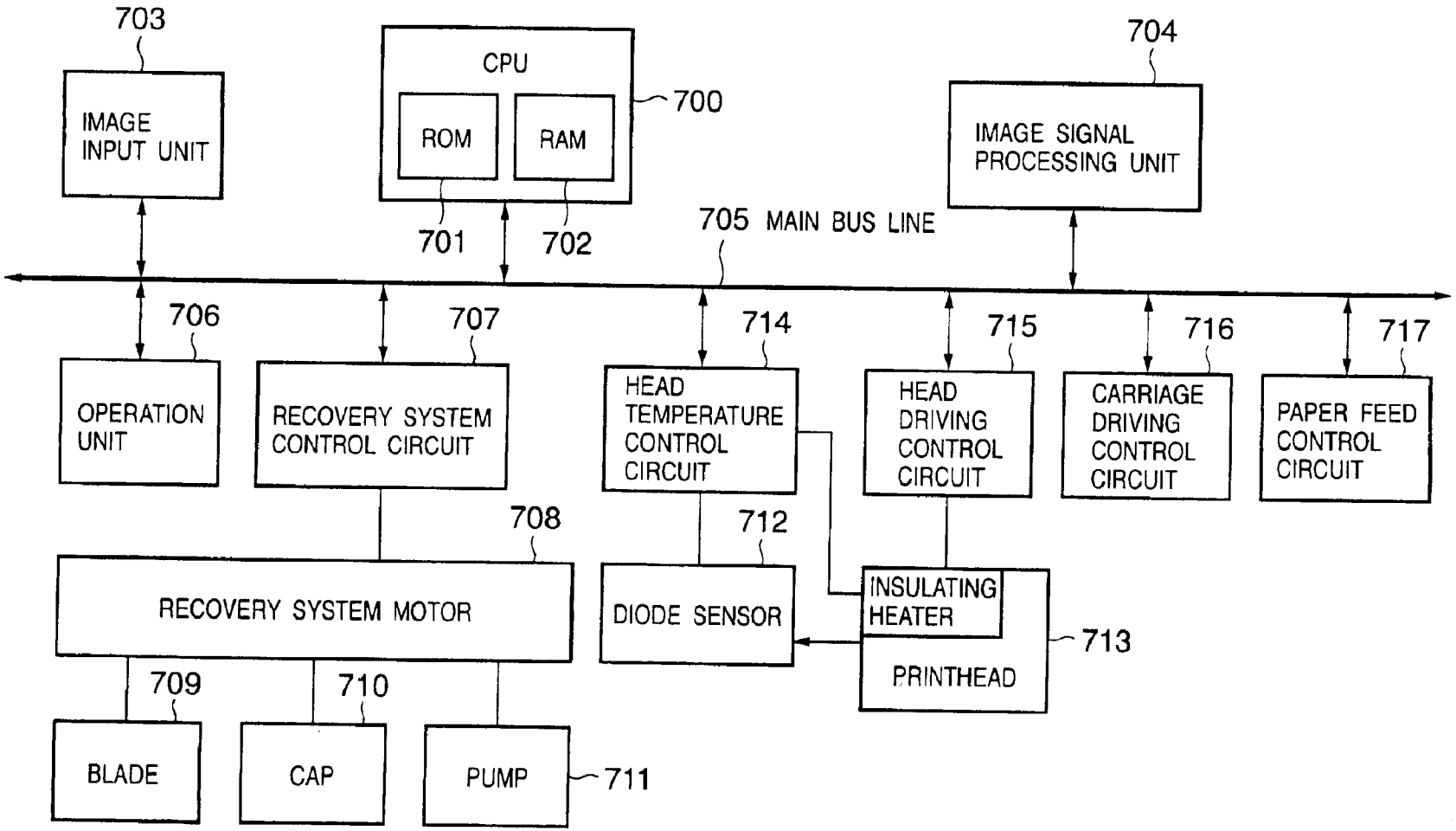
FIG. 7 is a block diagram showing a control arrangement for an ink-jet printing apparatus according to the present invention.

The overall arrangement of an ink-jet printing apparatus according to the present invention, which is common to the following embodiments, will be described first. FIG. 7 is a block diagram showing a control arrangement for the ink-jet printing apparatus according to the present invention. Note that the mechanical arrangement of this ink-jet printing apparatus is the same as that shown in FIG. 1.

The control arrangement shown in FIG. 7 can be roughly divided into software-related processing means such as an image input unit 703, an image signal processing unit 704 corresponding to the image input unit 703, and a CPU 700 serving as a central control unit, each of which accesses a main bus line 705, and hardware-related processing means such as an operation unit 706, a recovery system control circuit 707, an ink-jet head temperature control circuit 714, a head driving control circuit 715, a carriage driving control circuit 716 in the main scanning direction, and a paper feed control circuit 717 in the sub scanning direction.

The CPU 700 includes a general ROM 701 and a random-access memory (RAM) 702, and drives a printhead 713 by providing proper printing conditions with respect to input information to print. A program for executing head recovery processing is stored in the RAM 702, and gives recovery conditions such as predischarge conditions to the recovery system control circuit 707, printhead, insulating heater, and the like, as needed. A recovery system motor 708 drives the printhead 713 described above, a cleaning brake 709 facing it, a cap 710, and a suction pump 911. The head driving control circuit 715 executes operation based on driving conditions for electrothermal transducers for ink discharging operation of the printhead 713, and causes the printhead 713 to perform normal predischarging operation and printing ink discharging operation.

An insulating heater is mounted on a board on which electrothermal transducers for ink discharging operation of the printhead 713 are arranged. This makes it possible to heat/adjust the ink temperature in the printhead to a desired set temperature. A diode sensor 712 is also mounted on the board to measure the actual ink temperature in the printhead. The diode sensor 712 may also be mounted outside the board or may be mounted near the printhead.

Several embodiments of the ink-jet printing apparatus of the present invention having the above arrangement will be described below.

[First Embodiment]

This embodiment exemplifies a case wherein multilevel image data having each pixel expressed by 2 bits is printed to reproduce tones at a resolution of 600×600 dpi and expressing each pixel by a combination of a plurality of dots at different landing positions.

Figure 8:
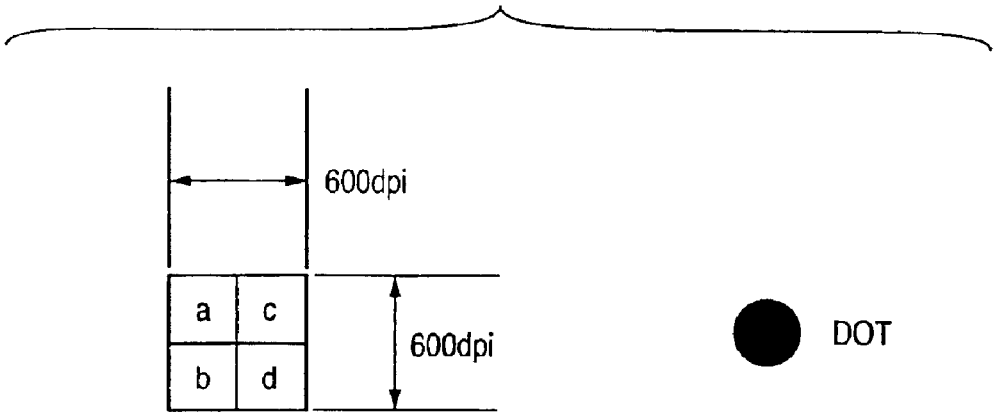
FIG. 8 is a view showing four-valued quantization levels and pixel patterns in the first embodiment of the present invention.

FIG. 8 is a view for explaining the correspondence between the quantization levels (gray levels) and the pixel patterns in this embodiment. As shown in FIG. 8, in this embodiment, each pixel is expressed by one of pixel patters (A) to (D) each constituted by four kinds of dots within a 2×2 matrix. Therefore, the amount of data stored as image information in a memory such as the RAM 702 in advance is 2 bits. Multilevel input image data is quantized into four-valued (level) data and converted into image data formed from four kinds of pixel patterns corresponding to the quantization levels as indicated by "(A)" to "(D)" in FIG. 8. The pixel pattern (A) is a pattern without any dot; the pixel pattern (D), an all-dot pattern; the pixel pattern (B), a low gray level pattern; and the pixel pattern (C), a medium gray level pattern.

Figure 9:
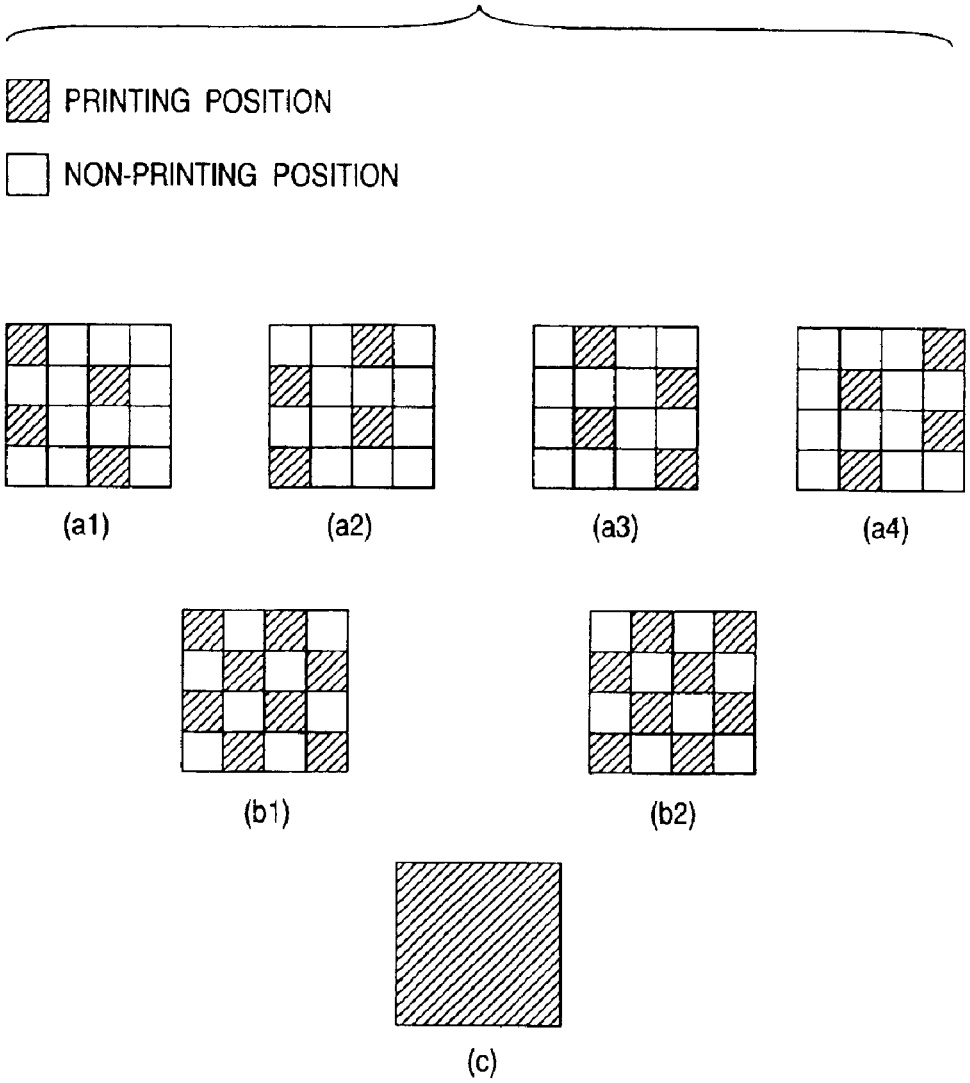
FIG. 9 is a view schematically showing mask patterns used in the first embodiment of the present invention.

FIG. 9 is a view showing mask patterns used in this embodiment. This embodiment uses mask patterns corresponding to 4×4 pixel areas. Four kinds of mask patterns from patterns (a1) to (a4) are complementary patterns each exhibiting a print area ratio of 25%. Likewise, two kinds of mask patterns (b1) and (b2) are complementary patterns each exhibiting a print area ratio of 50%. In a mask pattern (c), the print area ratio is 100%.

Figure 10:
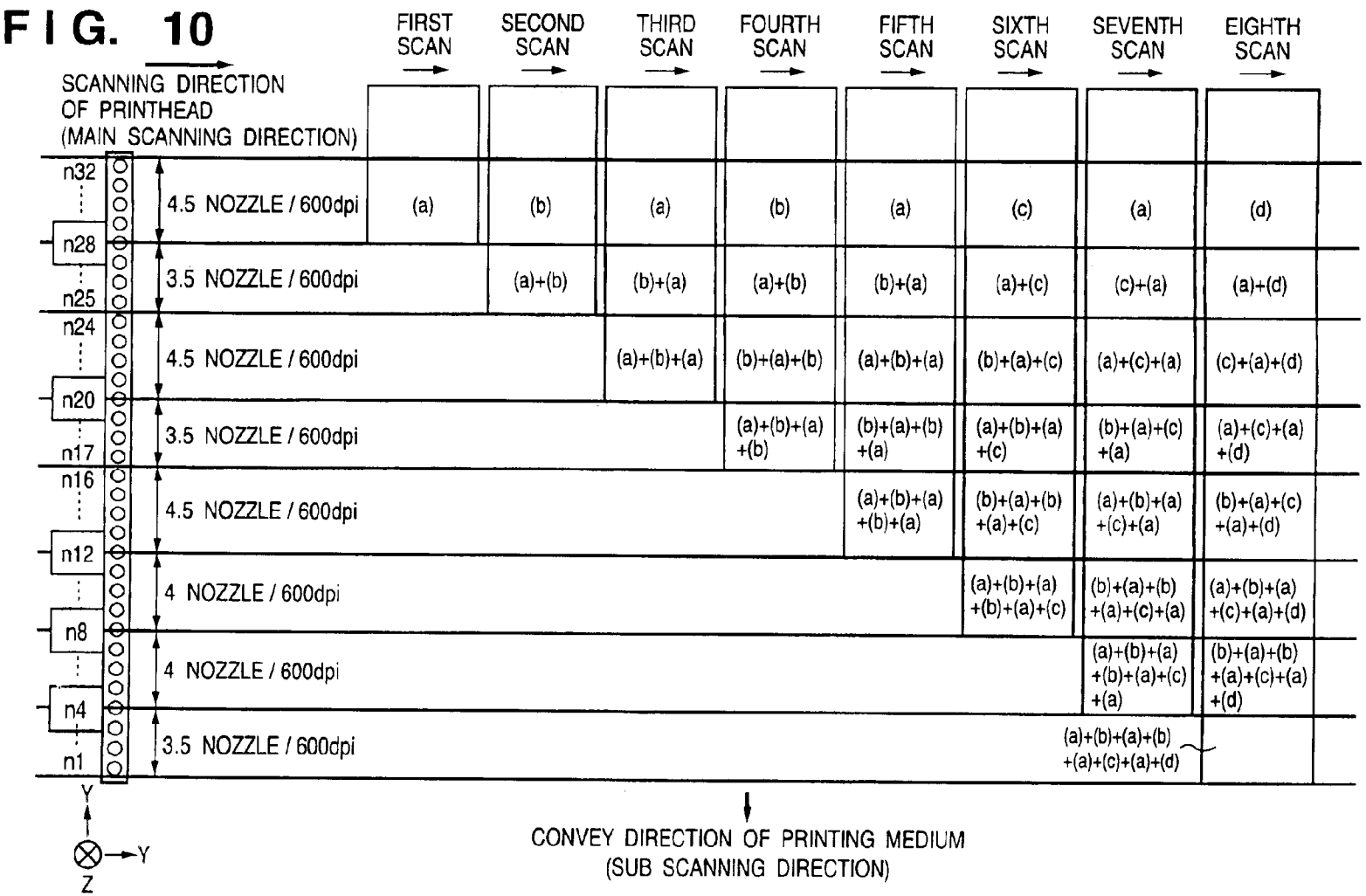
FIG. 10 is a view for explaining a printing method according to the first embodiment of the present invention.

FIG. 10 is a view for explaining how printing is done by eight scans using the printhead in this embodiment. The printhead has n=32 orifices (nozzles) at a density of N=600 per inch (600 dpi). In order to print the pixel patterns shown in FIG. 8 with a resolution higher than the arrangement resolution of nozzles of the printhead, two kinds of convey amounts, i.e., 4.5/600 inches and 3.5/600 inches, are used in addition to a convey amount of 4/600 inches obtained by dividing the printing width per scan by eight, thereby forming dots at 1,200 dpi and completing images.

Referring to FIG. 10, reference symbols (a) to (d) in the respective areas indicate which dots in the 2×2 matrix in FIG. 8 are printed.

Printing in each of eight scans executed on each area in this embodiment will be described below.

In the first scan, after a printing medium is conveyed by 4.5/600 inches, four nozzles from n29 to n32 of the 32 nozzles are used to print the data at the upper left position (a) in the (2×2) matrix of a low gray level pixel pattern with quantization level "1" indicated by (B) in FIG. 8 in the forward direction by using the mask pattern (a1) in FIG. 9.

In the second scan, after the printing medium is conveyed by 3.5/600 inches, eight nozzles from n25 to n32 of the 32 nozzles are used to print the data at the lower left position (b) in the (2×2) matrix of a medium gray level pixel pattern with quantization level "2" indicated by (C) in FIG. 8 in the forward direction by using the mask pattern (b1) in FIG. 9.

In the third scan, after the printing medium is conveyed by 4.5/600 inches, 12 nozzles from n21 to n32 of the 32 nozzles are used to print the data at the upper left position (a) in the (2×2) matrix of a low gray level pixel pattern with quantization level "1" indicated by (B) in FIG. 8 in the forward direction by using the mask pattern (a2) in FIG. 9.

In the fourth scan, after the printing medium is conveyed by 3.5/600 inches, 16 nozzles from n17 to n32 of the 32 nozzles are used to print the data at the lower left position (b) in the (2×2) matrix of a medium gray level pixel pattern with quantization level "2" indicated by (C) in FIG. 8 in the forward direction by using the mask pattern (b2) in FIG. 9.

In the fifth scan, after the printing medium is conveyed by 4.5/600 inches, 20 nozzles from n13 to n32 of the 32 nozzles are used to print the data at the upper left position (a) in the (2×2) matrix of a low gray level pixel pattern with quantization level "1" indicated by (B) in FIG. 8 in the forward direction by using the mask pattern (a3) in FIG. 9.

In the sixth scan, after the printing medium is conveyed by 4/600 inches, 24 nozzles from n9 to n32 of the 32 nozzles are used to print the data at the upper right position (c) in the (2×2) matrix of a high gray level pixel pattern with quantization level "3" indicated by (D) in FIG. 8 in the forward direction by using the mask pattern (c) in FIG. 9.

In the seventh scan, after the printing medium is conveyed by 4/600 inches, 24 nozzles from n5 to n32 of the 32 nozzles are used to print the data at the upper left position (a) in the (2×2) matrix of a low gray level pixel pattern with quantization level "1" indicated by (B) in FIG. 8 in the forward direction by using the mask pattern (a4) in FIG. 9.

In the eighth scan, after the printing medium is conveyed by 3.5/600 inches, 32 nozzles from n1 to n32 of the 32 nozzles are used to print the data at the lower right position (d) in the (2×2) matrix of a high gray level pixel pattern with quantization level "3" indicated by (D) in FIG. 8 in the forward direction by using the mask pattern (c) in FIG. 9.

In the ninth and subsequence scans, printing is performed by the same method as that in the first to eighth scans.

FIG. 16 shows a list of printing parameters for each scan, i.e., the convey amount of a printing medium, nozzles to be used, a dot position where printing is done, a mask pattern, and a scanning direction.

As described above, in printing 2-bit image data having each pixel quantized into four-valued data, the sixth and eighth scans are scans in which data in the pixel pattern with high quantization level "3" are completed without being superimposed on data with lower quantization levels "1" and "2". That is, the dots at the positions (c) and (d) in a high gray level pixel pattern are printed by one scan. In contrast to this, the dot at the position (a) in a low gray level (quantization level "1") pixel pattern is printed by one of the four scans, i.e., the first, third, fifth, and seventh scans, whereas the dot at the position (b) in a medium gray level (quantization level "2") is printed by one of two scans, i.e., the second and fourth scans.

Pixel patterns of low and medium gray level portions are completed by a plurality of scans in this manner. When low and medium gray level portions are to be printed, therefore, dots constituting adjacent pixels are printed by using different nozzles. This makes it possible to reduce the occurrence of density irregularity or streaks which are especially noticeable in a low gray level portion.

As described above, according to this embodiment, high-quality printing can be performed by reducing the occurrence of density irregularity or streaks which are especially noticeable in a low gray level portion with a low quantization level.

[Second Embodiment]

The second embodiment of the present invention will be described below. In the following description, a description of the same part as that in the first embodiment will be omitted, and a particular emphasis is placed on a characteristic feature of this embodiment.

In this embodiment, in the scheme of printing multilevel image data having each pixel expressed by 2 bits to reproduce tones at a resolution of 600×600 dpi by expressing each pixel using a combination of a plurality of dots at different landing positions, the scanning direction in which data with a low quantization level (gray level) is completed is made to differ from the scanning direction in which only data with a high quantization level is completed.

Assume that quantized pixel patterns in the second embodiment are the same as those shown in FIG. 8 which are used in the first embodiment, and the same mask patterns as those shown in FIG. 9 which are used in the first embodiment are used in the second embodiment.

Figure 11:
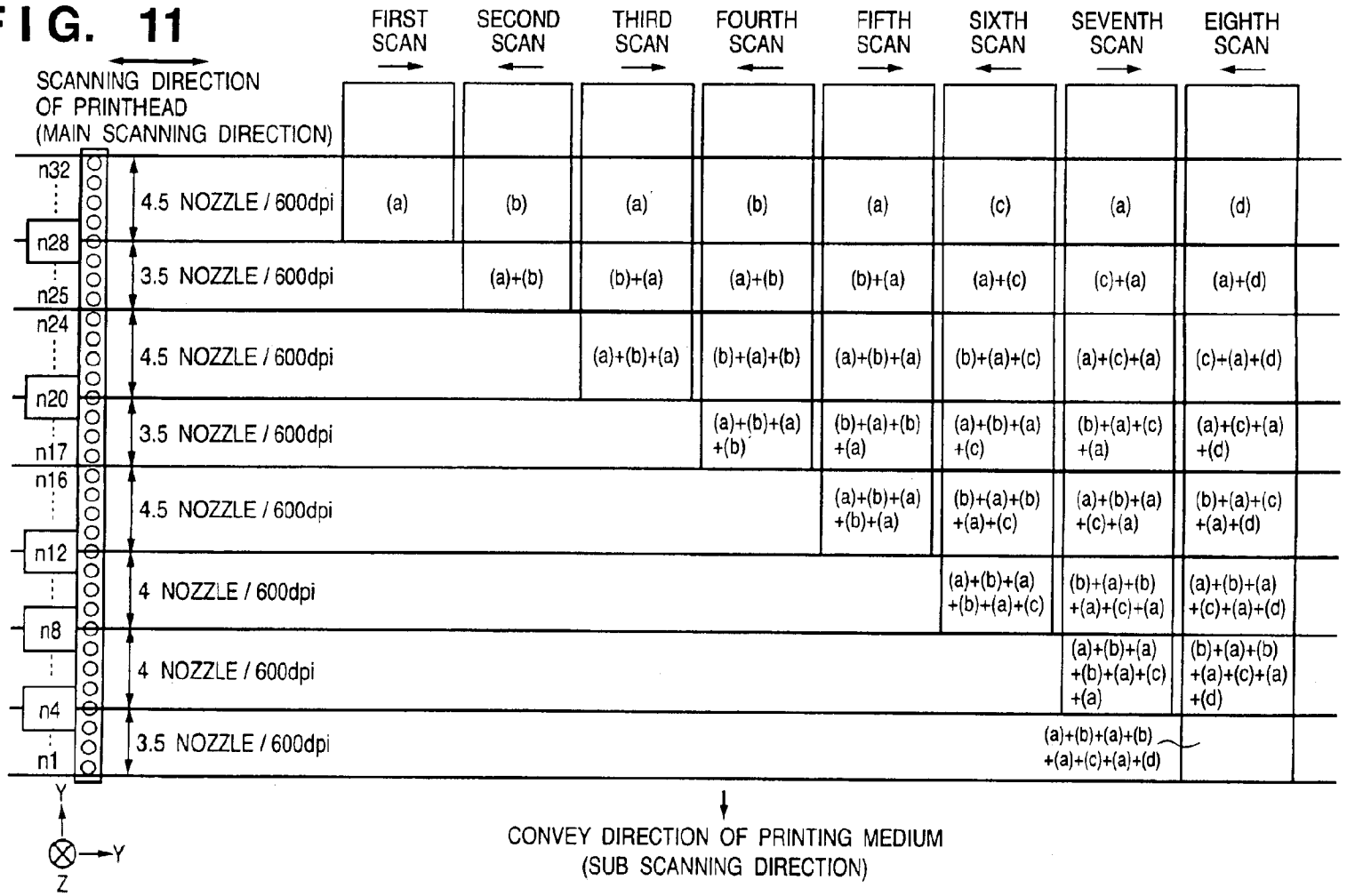
FIG. 11 is a view for explaining a printing method according to the second embodiment of the present invention.

Like FIG. 10, FIG. 11 shows how printing is performed by using a printhead in this embodiment and the respective scans. As shown in FIG. 11, although the printhead, the method of conveying a printing medium, and the number of scans performed to complete printing are the same as those in the first embodiment, reciprocating scanning operation is performed, in which scans are alternately performed in the forward and backward directions.

Four scans, i.e., the first, third, fifth, and seventh scans, are performed in the forward direction to print the data at the upper left position (a) in the (2×2) matrix (FIG. 8) of a low gray level pixel pattern with quantization level "1" indicated by (B) in FIG. 8 by using the four kinds of mask patterns (a1) to (a4) in FIG. 9, each exhibiting a print area ratio of 25%.

Two scans, i.e., the second and fourth scans, are performed in the backward direction to print the data at the lower left position (b) in the (2×2) matrix (FIG. 8) of a medium gray level pixel pattern with quantization level "2" indicated by (C) in FIG. 8 by using the two kinds of mask patterns (b1) and (b2) in FIG. 9, each exhibiting a print area ratio of 50%.

The sixth and eight scans, are performed in the backward direction to print the data at the upper right position (c) in the (2×2) matrix (FIG. 8) of a high gray level pixel pattern with quantization level "3" indicated by (D) in FIG. 8 by using the mask pattern (c) in FIG. 9, which exhibits a print area ratio of 100%.

FIG. 17 shows a list of printing parameters for each scan, i.e., the convey amount of a printing medium, nozzles to be used, a dot position where printing is done, a mask pattern, and a scanning direction.

As described above, in printing image data having each pixel expressed by 2 bits, a pixel pattern with quantization level "1" is printed by four scans in the forward direction, i.e., the first, third, fifth, and seventh scans. In contrast to this, pixel patterns with quantization levels "2" and "3" which are higher than quantization level "1" are printed by the second and fourth scans and the sixth and seventh scans in the backward direction, respectively.

As described above, a low gray level portion with a low quantization level is always printed by scans in the same forward direction. This makes it possible to reduce the occurrence of density irregularity due to a deterioration in landing precision in a low gray level portion which is susceptible to the influence of a deterioration in landing precision due to reciprocating printing and in which density irregularity is especially noticeable. In addition, since eight scans are performed in two directions instead of one direction, the printing speed can be increased about twice than that in the first embodiment.

As described above, this embodiment can satisfy both the requirement to reduce the occurrence of density irregularity and streaks which are noticeable in a low gray level portion with a low quantization level and the requirement to realize high-speed printing.

[Third Embodiment]

The third embodiment of the present invention will be described below. In the following description, a description of the same part as that in the first and second embodiments will be omitted, and a particular emphasis is placed on a characteristic feature of this embodiment.

In this embodiment, in the scheme of printing multilevel image data having each pixel expressed by 2 bits to reproduce tones at a resolution of 600×600 dpi by expressing each pixel using a combination of a plurality of dots at different landing positions, different pixel patterns are provided for the same quantization level (gray level).

Figure 12:
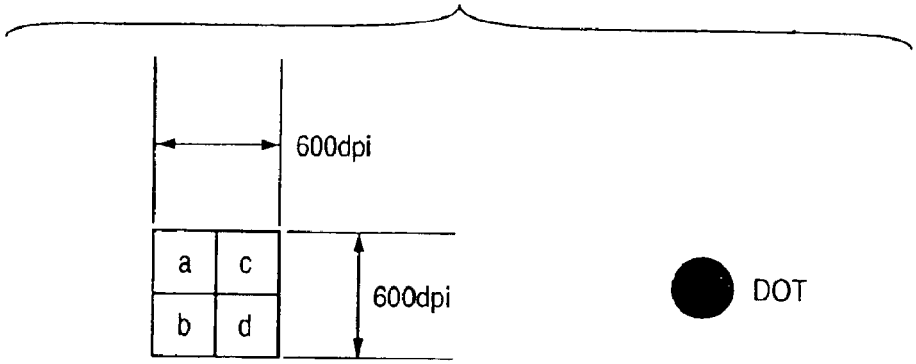
FIG. 12 is a view showing four-valued quantization levels and pixel patterns in the third embodiment of the present invention.

FIG. 12 is a view for explaining the correspondence between the quantization levels (gray levels) and the pixel patterns in this embodiment. As shown in FIG. 12, in this embodiment, each pixel is expressed by one of pixel patters (A) to (E) each constituted by four kinds of dots within a 2×2 matrix. Therefore, the amount of data stored as image information in a memory such as a RAM 702 in advance is 2 bits. Multilevel input image data is quantized into four-valued (level) data and converted into image data formed from five kinds of pixel patterns corresponding to the quantization levels as indicated by "(A)" to "(E)" in FIG. 12.

As shown in FIG. 12, the patterns (A), (D), and (E) uniquely correspond to quantization levels "0", "2", and "3", respectively. However, for quantization level "1", two kinds of pixel patterns (B) and (C) are prepared. Assume that the two kinds of pixel patterns corresponding to this quantization level "1" are alternately assigned every time image data with quantization level "1" is generated.

Figure 13:
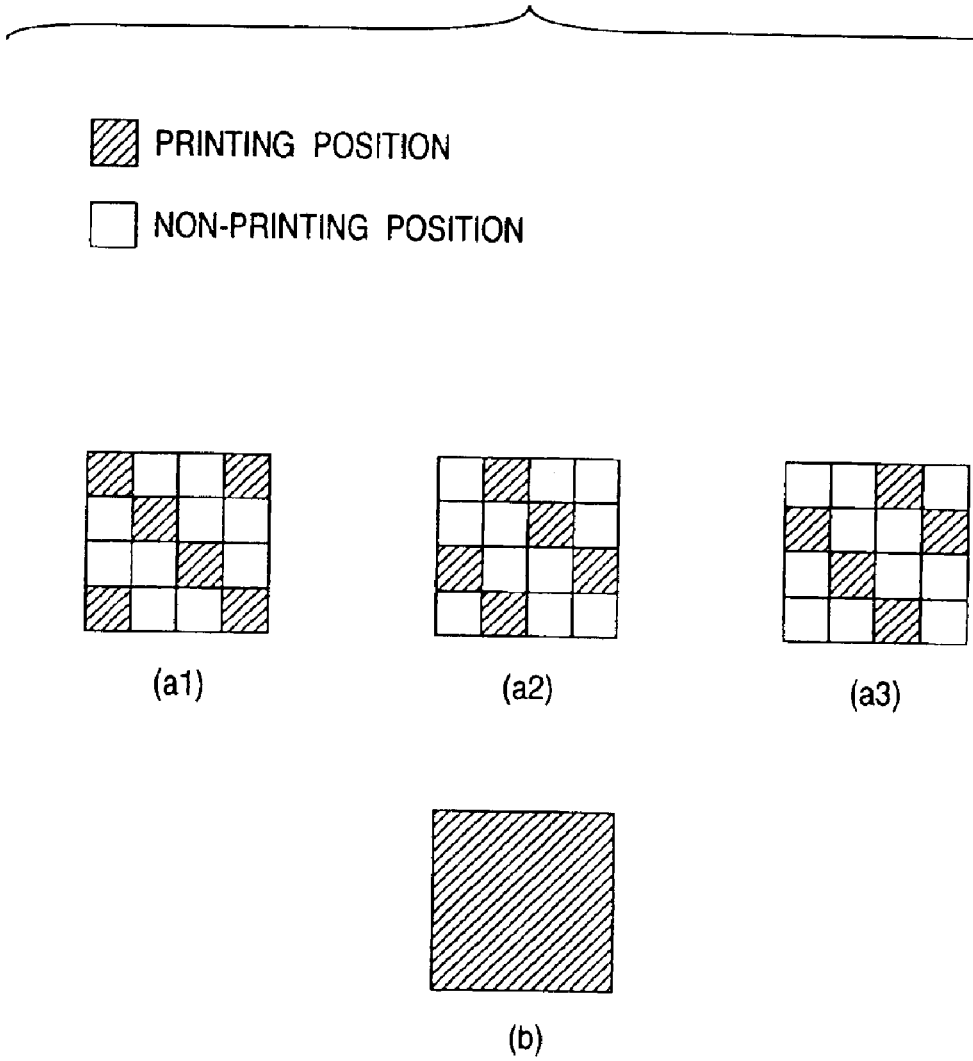
FIG. 13 is a view schematically showing mask patterns used in the third embodiment of the present invention.

FIG. 13 is a view showing the mask patterns to be used in this embodiment. In this embodiment, mask patterns corresponding to 4×4 pixel areas are used. Three kinds of mask patterns (a1) to (a3) are complementary patterns each exhibiting a print area ratio of 33.3% (⅓), whereas a mask pattern (b) is a pattern which exhibits a print area ratio of 100%.

Figure 14:
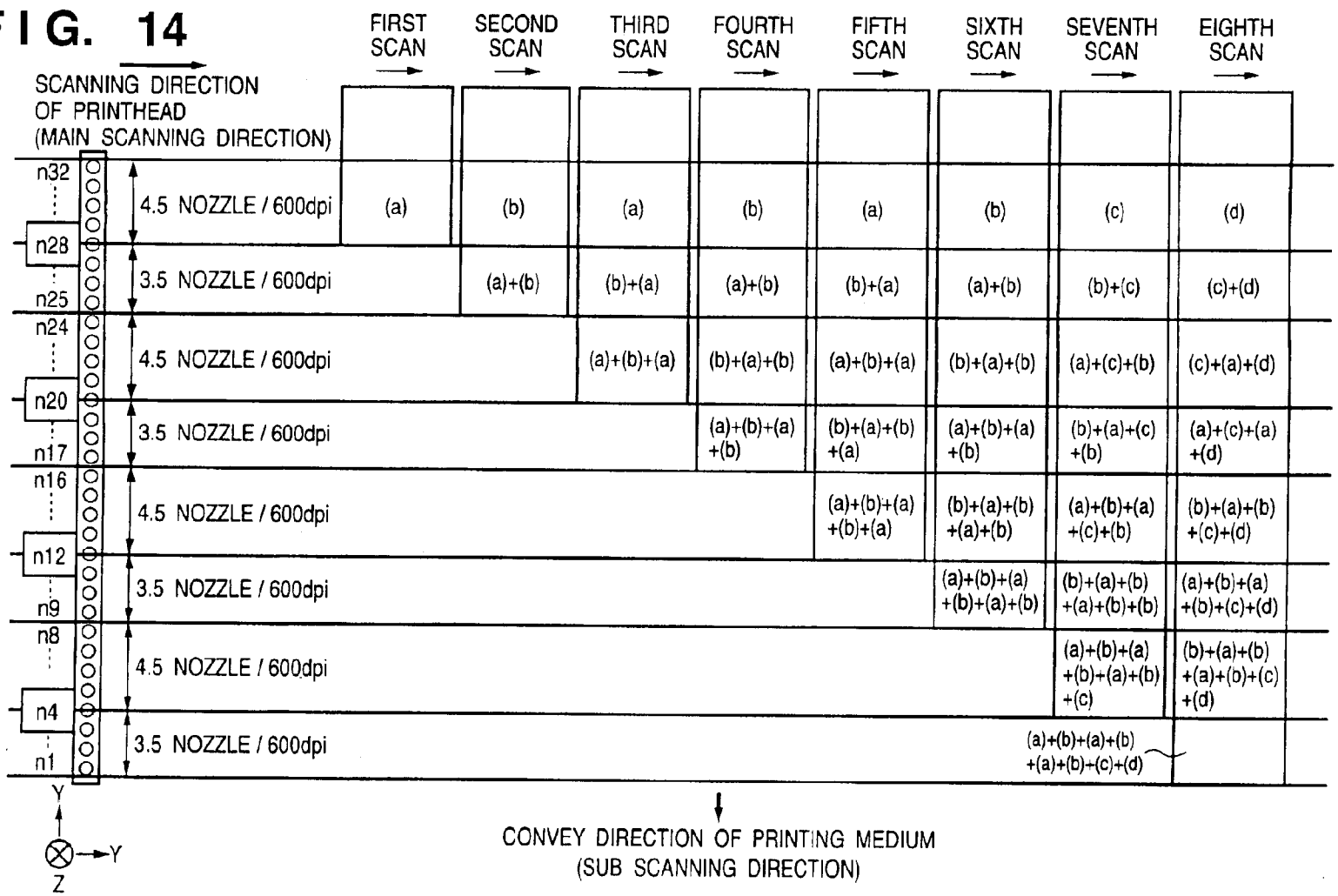
FIG. 14 is a view for explaining a printing method according to the third embodiment of the present invention.

FIG. 14 is a view for explaining how printing is done by eight scans using the printhead in this embodiment. The printhead has n=32 orifices (nozzles) at a density of N=600 per inch (600 dpi). In order to print the pixel patterns shown in FIG. 12 with a resolution higher than the arrangement resolution of nozzles of the printhead, two kinds of convey amounts, i.e., 4.5/600 inches and 3.5/600 inches, are used in addition to a convey amount of 4/600 inches obtained by dividing the printing width per scan by eight, thereby forming dots at 1,200 dpi and completing images.

Referring to FIG. 14, reference symbols (a) to (d) in the respective areas indicate which dots in the 2×2 matrix in FIG. 12 are printed.

Printing in each of eight scans executed on each area in this embodiment will be described below.

In the first scan, after a printing medium is conveyed by 4.5/600 inches, four nozzles from n29 to n32 of the 32 nozzles are used to print the data at the upper left position (a) in the (2×2) matrix of a low gray level pixel pattern with quantization level "1" indicated by (B) in FIG. 12 in the forward direction by using the mask pattern (a1) in FIG. 13.

In the second scan, after the printing medium is conveyed by 3.5/600 inches, eight nozzles from n25 to n32 of the 32 nozzles are used to print the data at the lower left position (b) in the (2×2) matrix of a low gray level pixel pattern with quantization level "1" indicated by (C) in FIG. 12 in the forward direction by using the mask pattern (a1) in FIG. 13.

In the third scan, after the printing medium is conveyed by 4.5/600 inches, 12 nozzles from n21 to n32 of the 32 nozzles are used to print the data at the upper left position (a) in the (2×2) matrix of a low gray level pixel pattern with quantization level "1" indicated by (B) in FIG. 12 in the forward direction by using the mask pattern (a2) in FIG. 13.

In the fourth scan, after the printing medium is conveyed by 3.5/600 inches, 16 nozzles from n17 to n32 of the 32 nozzles are used to print the data at the lower left position (b) in the (2×2) matrix of a low gray level pixel pattern with quantization level "1" indicated by (C) in FIG. 12 in the forward direction by using the mask pattern (a2) in FIG. 13.

In the fifth scan, after the printing medium is conveyed by 4.5/600 inches, 20 nozzles from n13 to n32 of the 32 nozzles are used to print the data at the upper left position (a) in the (2×2) matrix of a low gray level pixel pattern with quantization level "1" indicated by (B) in FIG. 12 in the forward direction by using the mask pattern (a3) in FIG. 13.

In the sixth scan, after the printing medium is conveyed by 3.5/600 inches, 24 nozzles from n9 to n32 of the 32 nozzles are used to print the data at the lower left position (b) in the (2×2) matrix of a low gray level pixel pattern with quantization level "1" indicated by (C) in FIG. 12 in the forward direction by using the mask pattern (a3) in FIG. 13.

In the seventh scan, after the printing medium is conveyed by 4.5/600 inches, 24 nozzles from n5 to n32 of the 32 nozzles are used to print the data at the upper right position (c) in the (2×2) matrix of a high gray level pixel pattern with quantization level "3" indicated by (E) in FIG. 12 in the forward direction by using the mask pattern (c) in FIG. 13.

In the eighth scan, after the printing medium is conveyed by 3.5/600 inches, 32 nozzles from n1 to n32 of the 32 nozzles are used to print the data at the lower right position (d) in the (2×2) matrix of a high gray level pixel pattern with quantization level "3" indicated by (E) in FIG. 12 in the forward direction by using the mask pattern (c) in FIG. 13.

In the ninth and subsequence scans, printing is performed by the same method as that in the first to eighth scans.

FIG. 18 shows a list of printing parameters for each scan, i.e., the convey amount of a printing medium, nozzles to be used, a dot position where printing is done, a mask pattern, and a scanning direction.

As described above, in printing 2-bit image data having each pixel quantized into four-valued data, the seventh and eighth scans are scans in which data in the pixel pattern with high quantization level "3" are completed without being superimposed on data with lower quantization levels "1" and "2". That is, the dots at the positions (c) and (d) in a high gray level pixel pattern are printed by one scan. In contrast to this, the dot at the position (a) in a low gray level (quantization level "1") pixel pattern is printed by one of the three scans, i.e., the first, third, and fifth scans, whereas the dot at the position (b) is printed by one of three scans, i.e., the second, fourth, and sixth scans.

Pixel patterns of low and medium gray level portions are completed by a plurality of scans in this manner. When low and medium gray level portions are to be printed, therefore, dots constituting adjacent pixels are printed by using different nozzles. This makes it possible to reduce the occurrence of density irregularity or streaks which are especially noticeable in a low gray level portion.

In this case, the dots at the positions (a) and (b) are printed at a ratio of 33.3% by one scan. However, since image data with quantization level "1" is assigned to one of the two kinds of patterns (B) and (C) in FIG. 12, the print area ratio is 16.6%, which is ½ that above ratio. This makes it possible to further effectively suppress the occurrence of density irregularity and streaks which are noticeable in a low gray level portion with a low quantization level.

In this embodiment, the two kinds of pixel patterns corresponding to quantization level "1" are regularly assigned to image data every time it is generated. However, such patterns may be regularly assigned according to the position of data on a printing medium or may be assigned in a random order.

As described above, according to this embodiment, high-quality printing can be performed by further effectively suppressing the occurrence of density irregularity or streaks which are especially noticeable in a low gray level portion with a low quantization level.

[Fourth Embodiment]

The fourth embodiment of the present invention will be described below. In the following description, a description of the same part as that in the first and second embodiments will be omitted, and a particular emphasis is placed on a characteristic feature of this embodiment.

In this embodiment, in the scheme of multilevel image data having each pixel expressed by 2 bits to reproduce tones at a resolution of 600×600 dpi by expressing each pixel using a combination of a plurality of dots at different landing positions, scanning operation for printing data, of data with a high quantization level, which does not overlap data with a low quantization level is performed at equal intervals in each scan.

Assume that quantized pixel patterns in the fourth embodiment are the same as those shown in FIG. 8 which are used in the first and second embodiments, and the same mask patterns as those shown in FIG. 9 which are used in the first and second embodiments are used in the fourth embodiment.

Figure 15:
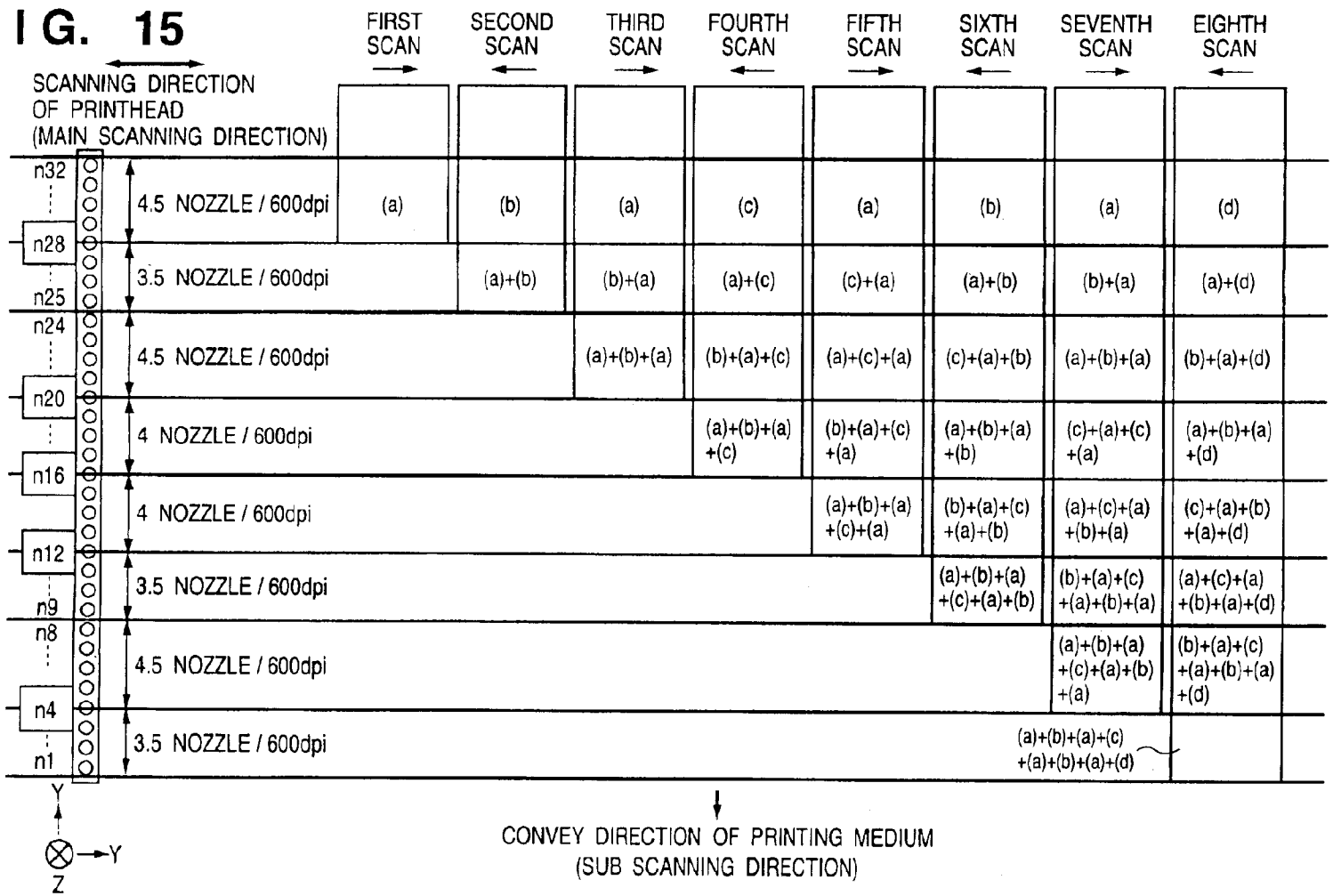
FIG. 15 is a view for explaining a printing method according to the fourth embodiment of the present invention.

Like FIGS. 10 and 11, FIG. 15 shows how printing is performed by using a printhead in this embodiment and the respective scans. As shown in FIG. 15, the number of scans required to print all image data are eight, which is the same as in the first to third embodiments, and the same reciprocating printing method as in the second embodiment is used, in which scanning is alternately done in the forward and backward directions. This method differs from that shown in FIGS. 10 and 11 in that the dots at the positions (a) to (d) in a (2×2) matrix in FIG. 8 are printed in a different order.

Referring to FIG. 15, reference symbols (a) to (d) in the respective areas indicate which dots in the 2×2 matrix in FIG. 8 are printed.

Printing in each of eight scans executed on each area in this embodiment will be described below.

In the first scan., after a printing medium is conveyed by 4.5/600 inches, four nozzles from n29 to n32 of the 32 nozzles are used to print the data at the upper left position (a) in the (2×2) matrix of a low gray level pixel pattern with quantization level "1" indicated by (B) in FIG. 8 in the forward direction by using the mask pattern (a1) in FIG. 9.

In the second scan, after the printing medium is conveyed by 3.5/600 inches, eight nozzles from n25 to n32 of the 32 nozzles are used to print the data at the lower left position (b) in the (2×2) matrix of a medium gray level pixel pattern with quantization level "2" indicated by (C) in FIG. 8 in the backward direction by using the mask pattern (b1) in FIG. 9.

In the third scan, after the printing medium is conveyed by 4.5/600 inches, 12 nozzles from n21 to n32 of the 32 nozzles are used to print the data at the upper left position (a) in the (2×2) matrix of a low gray level pixel pattern with quantization level "1" indicated by (B) in FIG. 8 in the forward direction by using the mask pattern (a2) in FIG. 9.

In the fourth scan, after the printing medium is conveyed by 4/600 inches, 16 nozzles from n17 to n32 of the 32 nozzles are used to print the data at the upper right position (c) in the (2×2) matrix of a high gray level pixel pattern with quantization level "31" indicated by (D) in FIG. 8 in the backward direction by using the mask pattern (c) in FIG. 9.

In the fifth scan, after the printing medium is conveyed by 4/600 inches, 20 nozzles from n13 to n32 of the 32 nozzles are used to print the data at the upper left position (a) in the (2×2) matrix of a low gray level pixel pattern with quantization level "1" indicated by (B) in FIG. 8 in the forward direction by using the mask pattern (a3) in FIG. 9.

In the sixth scan, after the printing medium is conveyed by 3.5/600 inches, 24 nozzles from n9 to n32 of the 32 nozzles are used to print the data at the lower left position (b) in the (2×2) matrix of a medium gray level pixel pattern with quantization level "1" indicated by (C) in FIG. 8 in the backward direction by using the mask pattern (b2) in FIG. 9.

In the seventh scan, after the printing medium is conveyed by 4.5/600 inches, 24 nozzles from n5 to n32 of the 32 nozzles are used to print the data at the upper left position (a) in the (2×2) matrix of a low gray level pixel pattern with quantization level "1" indicated by (B) in FIG. 8 in the forward direction by using the mask pattern (a4) in FIG. 9.

In the eighth scan, after the printing medium is conveyed by 3.5/600 inches, 32 nozzles from n1 to n32 of the 32 nozzles are used to print the data at the lower right position (d) in the (2×2) matrix of a high gray level pixel pattern with quantization level "3" indicated by (D) in FIG. 8 in the backward direction by using the mask pattern (c) in FIG. 9.

In the ninth and subsequence scans, printing is performed by the same method as that in the first to eighth scans.

FIG. 19 shows a list of printing parameters for each scan, i.e., the convey amount of a printing medium, nozzles to be used, a dot position where printing is done, a mask pattern, and a scanning direction.

As described above, in printing 2-bit image data having each pixel quantized into four-valued data, the fourth and eighth scans are scans in which data in the pixel pattern with high quantization level "3" are completed without being superimposed on data with lower quantization levels "1" and "2". That is, the dots at the positions (c) and (d) in a high gray level pixel pattern are printed by one scan. In contrast to this, the dot at the position (a) in a low gray level (quantization level "1") pixel pattern is printed by one of the four scans, i.e., the first, third, fifth, and seventh scans, whereas the dot at the position (b) in a medium gray level (quantization level "2") is printed by one of two scans, i.e., the second and sixth scans.

As described above, in this embodiment, scanning operation for printing medium and high gray level pixel patterns each constituted by a plurality of dots is performed at intervals corresponding to every other scans (eight times). By performing scanning operation at equal intervals in this manner, the time intervals at which dots constituting the same pixel are printed can be maintained constant. This makes it possible to effectively suppress the occurrence of density irregularity and streaks even in medium and high gray level portions.

In addition, a low gray level portion with a low quantization level is always printed by scans in the same forward direction. This makes it possible to suppress the occurrence of density irregularity due to a deterioration in landing precision in a low gray level portion which is susceptible to the influence of a deterioration in landing precision due to reciprocating printing and in which density irregularity is especially noticeable. In addition, since eight scans are performed in two directions instead of one direction, the printing speed can be increased about twice than that in the first embodiment.

As described above, according to this embodiment, the occurrence of density irregularity and streaks can be effectively reduced in medium and high gray level portions as well as a low gray level portion with a low quantization level, thereby realizing high-quality printing. In addition, an increase in printing speed can be attained.

[Fifth Embodiment]

In the fifth embodiment, four-valued data (pixel data with one of gray levels 0 to 3) having each pixel expressed by 2 bits is printed to reproduce tones by using a pixel pattern having a resolution of 600×600 dpi. According to a characteristic feature of this embodiment, pixels having the lowest and second lowest gray level values (gray levels 1 and 2), of a plurality of gray level values from which the gray level value (gray level 0=quantization level 0) corresponding to the lowest density (no dot) is excluded, are printed to reproduce tones by using pixel patterns constituted by dots at substantially the same landing position, whereas pixels having higher gray level values (gray level 3 or higher) are printed to reproduce tones by using a pixel pattern constituted by a plurality of dots at different landing positions.

Figure 22:
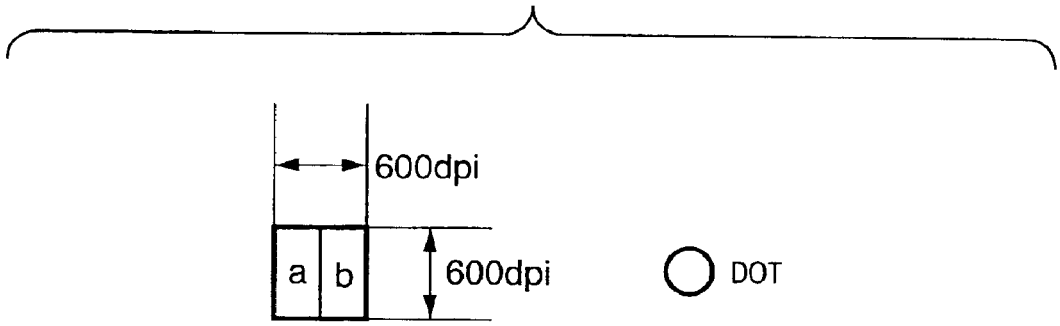
FIG. 22 is a view showing four quantization levels and pixel patterns according to the fifth embodiment of the present invention.

FIG. 22 is a view for explaining the correspondence between the quantization levels (gray levels) and the pixel patterns in this embodiment. In the embodiment, pixels corresponding to quantization levels 0 to 3 are expressed by using four kinds of pixel patterns (A) to (D) each having dots arranged in a 2 (vertical)×1 (horizontal) matrix. Therefore, the amount of data stored as image information in a memory such as a RAM 702 in advance is 2 bits. Multilevel input image data is quantized into four-valued (level) data and converted into image data formed from four kinds of pixel patterns corresponding to the quantization levels as indicated by "(A)" to "(D)" in FIG. 22. Referring to FIG. 22, the pixel pattern (A) with quantization level "0" is a pattern without any dot; the pixel pattern (B) with quantization level "1", a pattern in which one dot is placed on the left side; the pixel pattern (C) with quantization level "2", a pattern in which two dots are superimposed on the left side; and the pixel pattern (D) with quantization level "3", a pattern in which two dots are superimposed on each of the left and right sides.

Figure 23:
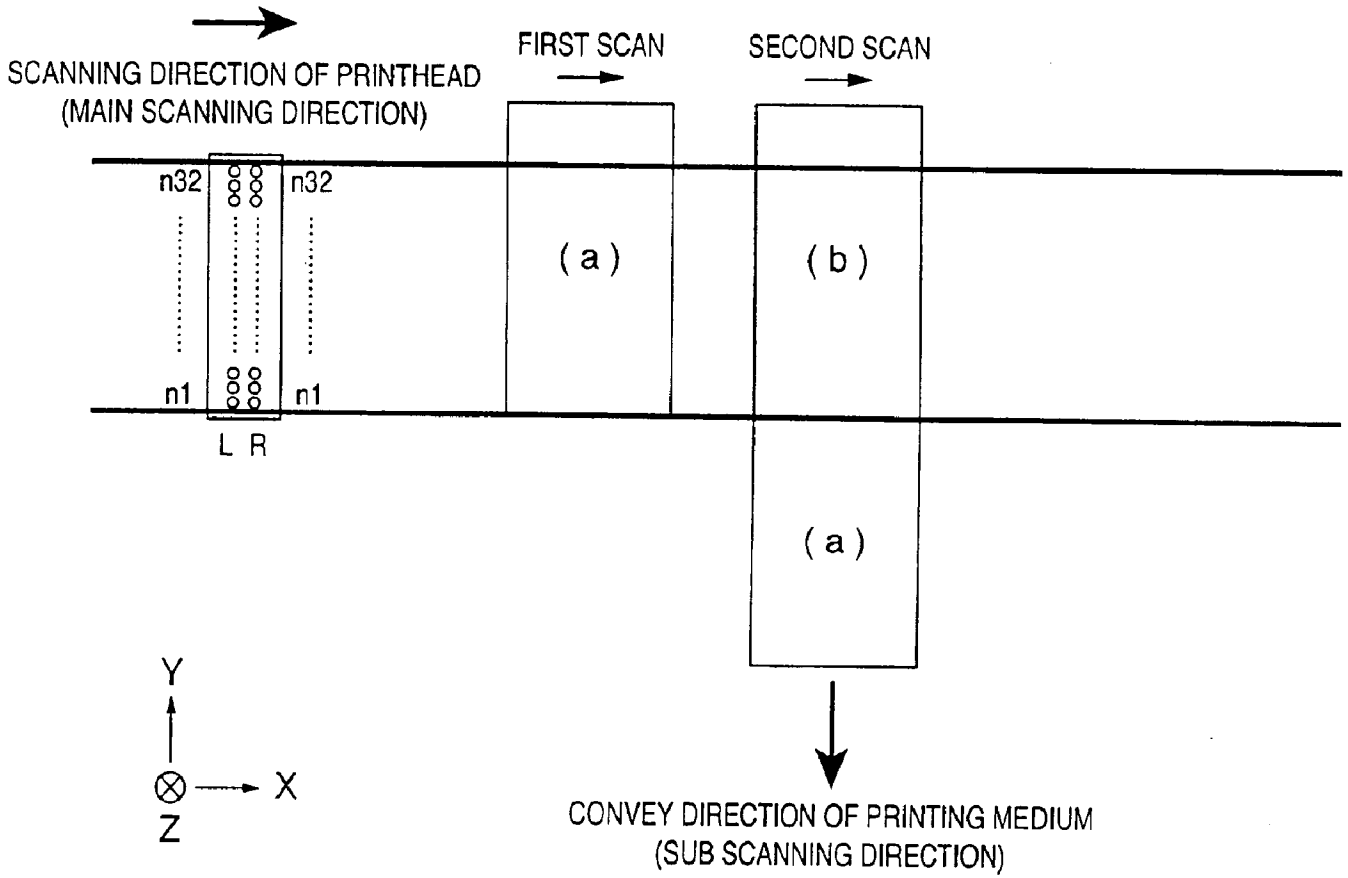
FIG. 23 is a view for explaining a printing method according to the fifth embodiment of the present invention.

FIG. 23 is a view for explaining how printing is done by one scan using a printhead according to this embodiment. The printhead has two arrays (R and L) each having n=32 orifices (nozzles) at a density of N=600 per inch (600 dpi). In printing operation, first of all, a printing medium is conveyed to the position of the nozzles to be used, and the printhead is scanned in the main scanning direction (the X direction indicated by the arrow), thereby printing an area (a) in FIG. 23 in the first scan. Thereafter, the printing medium is conveyed by a convey amount corresponding to the nozzle width, i.e., 32/600 inches, and the printhead is returned, thereby printing an area (b) in FIG. 23 in the X direction indicated by the arrow in the second scan. An image is completed by one-pass printing operation of repeatedly conveying the printing medium by the nozzle width, i.e., 32/600 inches and printing by one main scanning operation. In this one main scanning operation, in order to print the pattern (B) with quantization level "1" in FIG. 22, a dot is placed on the left area of the two areas divided from a matrix with 600×600 dpi in the main scanning direction by using one of the nozzle arrays R and L. In order to print the pattern (C) with quantization level "2" in FIG. 22, dots are superimposed on the left area of the two areas divided from a matrix with 600×600 dpi in the main scanning direction by using the two nozzle arrays R and L. In order to print the pattern (D) with quantization level "3" in FIG. 22, dots are superimposed on both the left and right areas divided from a matrix with 600×600 dpi in the main scanning direction by using the two nozzle arrays R and L.

In this embodiment, the dot landing position in the pixel pattern with quantization level "1" (the pixel pattern (B) in FIG. 22) is set to be substantially the same as that in the pixel pattern with quantization level "2" (the pixel pattern (C) in FIG. 22). Such a dot arrangement is used to reduce graininess in a low gray level portion. On the other hand, the pixel pattern with quantization level "3" (the pixel pattern (D) in FIG. 22) has a dot arrangement in which dots land at two or more different positions instead of the same position. Such a dot arrangement is used to ensure a sufficient area factor by filling the matrix with dots as much as possible in order to meet the requirement to increase the density of a high gray level portion. With the dot arrangement like that of the pattern (D) in FIG. 22, a sufficient area factor is ensured, and hence a high gray level portion with a sufficient density can be formed.

Figure 20:
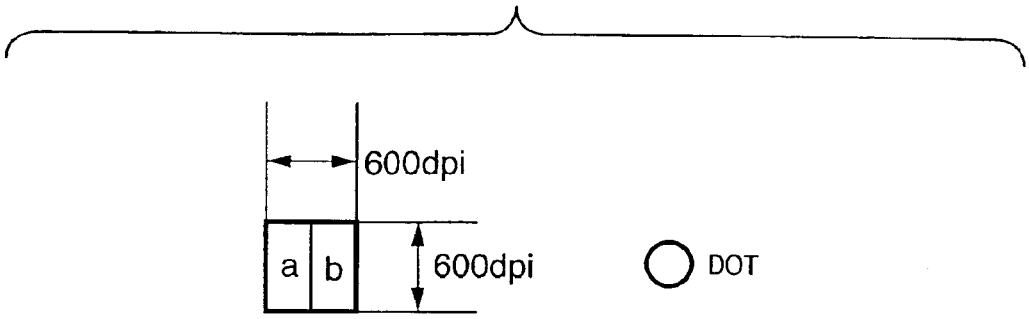
FIG. 20 is a view showing four quantization levels and pixel patterns in the prior art.
Figure 24A:
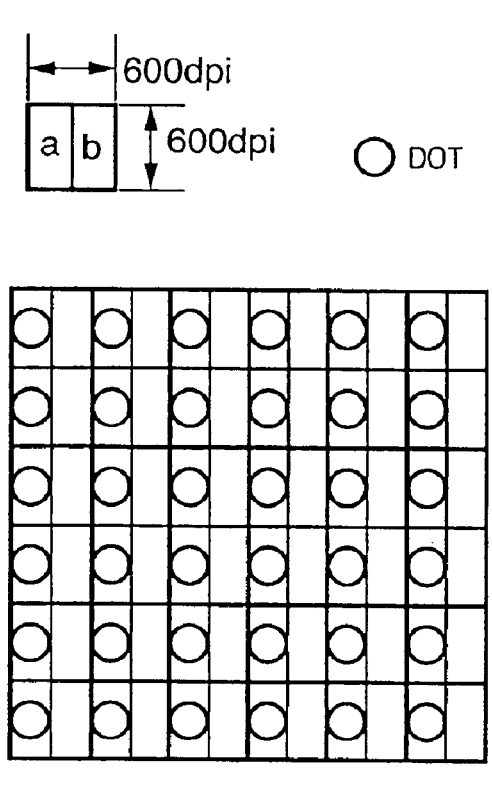
FIGS. 24A and 24B are views each for explaining a printed state that reduces graininess according to the fifth embodiment of the present invention.
Figure 24B:
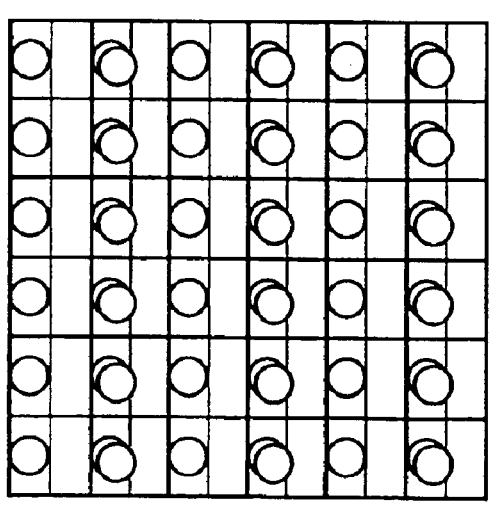

FIG. 24A shows a case wherein pixel patterns with quantization level "1" (each identical to the pixel pattern (B) in FIG. 22) are arranged adjacent to each other in the main scanning direction. In this case, since a dot is placed on only the left area in each matrix and the intervals between the dots become uniform, graininess (noise) like that caused by the coarse and dense portions in FIG. 20A is suppressed. FIG. 24B shows an image constituted by pixel patterns with quantization level "1" (each identical to the pixel pattern (B) in FIG. 22) and pixel patterns with quantization level "2" (each identical to the printhead (C) in FIG. 22). In this case, the pixel pattern having two dots superimposed on the left area in the matrix (the pixel pattern (C) in FIG. 22) exists on the right side of each pixel pattern having only one dot placed on the left side in the matrix (the pixel pattern (B) in FIG. 22), and hence the intervals between the dots become uniform as in the case shown in FIG. 24A. Therefore, graininess (noise) like that caused by the coarse and dense portions in FIG. 20B is suppressed.

Figure 25:
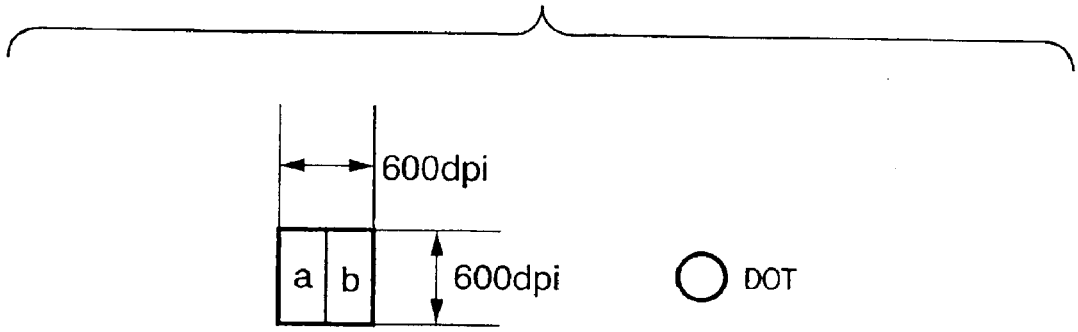
FIG. 25 is a view showing other four quantization levels and pixel patterns according to the fifth embodiment of the present invention.

This embodiment has exemplified the case wherein four gray levels are expressed by using the pixel patterns (pixel patterns in FIG. 22) for landing 0, one, two, and four dots with respect to pixels with 600×600 dpi. However, pixel patterns to be used to express four gray levels are not limited to them. For example, as shown in FIG. 25, in expressing four gray levels, a pixel pattern in which two dots are superimposed on the left area in a matrix and one dot is placed on the right area (a pixel pattern (D) in FIG. 25) or a pixel pattern in which one dot is placed on the left area in a matrix and two dots are superimposed on the right area (a pixel pattern (E) in FIG. 25) may be used as a pixel pattern to print a pixel with gray level "3" that is the highest gray level value. In this case, the two kinds of pixel patterns (D) and (E) corresponding to quantization level "3" may be regularly selected in accordance with the image printing position or the occurrence of data with quantization level "3". If, however, there is a factor that causes a deterioration in landing precision, these pixel patterns are preferably selected randomly. In this embodiment, tone reproduction may be realized by using the pixel patterns shown in FIG. 25. Even in this case, as in the case wherein the pixel patterns in FIG. 22 are used, patterns of one kind having a dot arrangement that causes dots to land at the same position are used as pixel patterns corresponding to quantization levels "1" and "2" which are used to print a low gray level portion, whereas a pattern having a dot arrangement that causes dots to land at two or more different positions is used as a pixel pattern corresponding to quantization level "3" which is used to print a high gray level portion. With these patterns, the same effect as that described above can be obtained.

Figure 26:
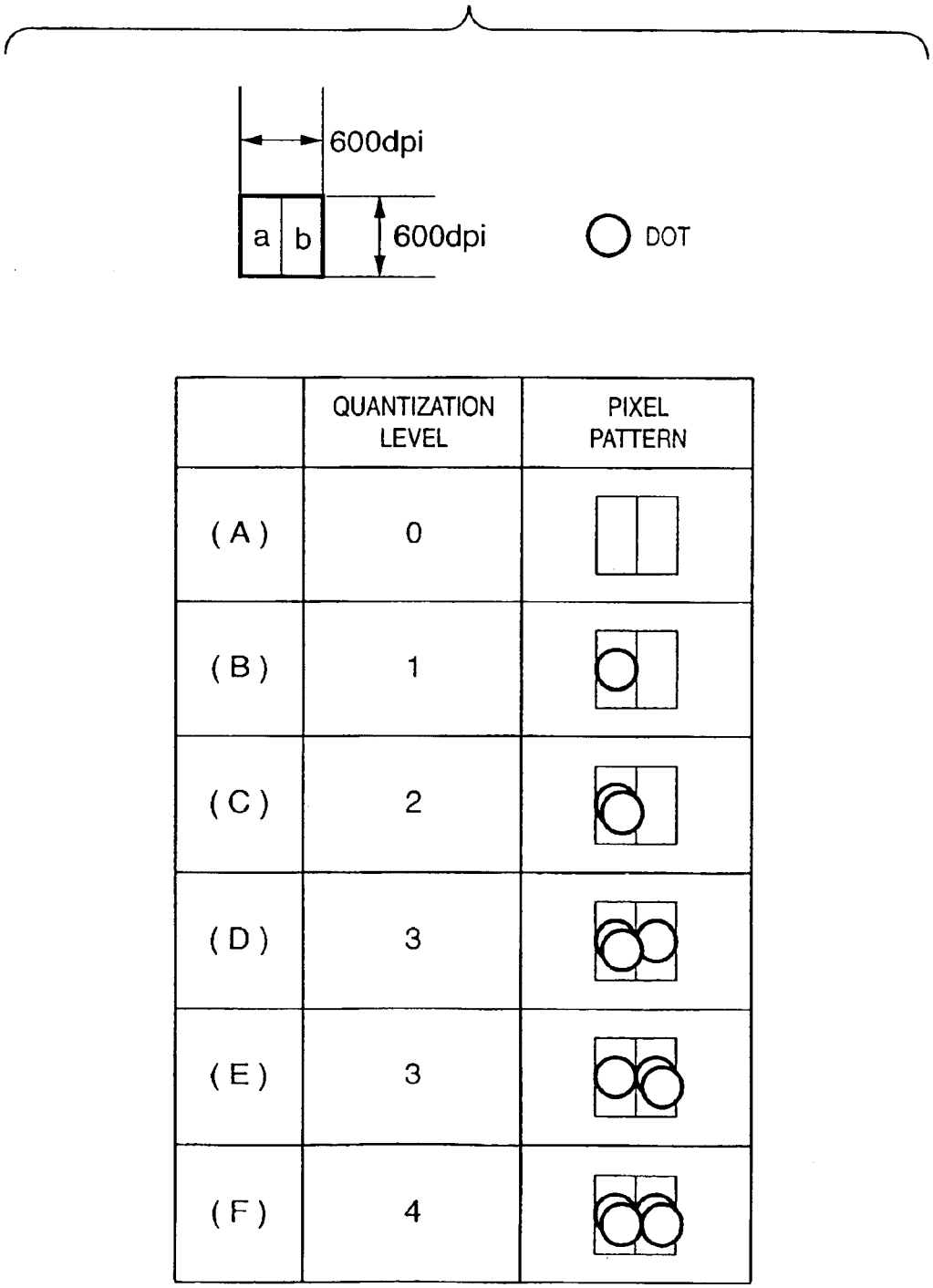
FIG. 26 is a view showing five quantization levels and pixel patterns according to the fifth embodiment of the present invention.

In the case of five-valued data shown in FIG. 26, as in the case of four-valued data, pixels having the lowest and second lowest gray level values (gray levels "1" and "2"), of a plurality of gray level values from which the gray level value (gray level 0=quantization level 0) corresponding to the lowest density (no dot) is excluded, are printed by using pixel patterns (pixel patterns (B) and (C) in FIG. 26) constituted by dots at substantially the same landing position. Pixels having higher gray level values (quantization levels "3" and "4") are printed to reproduce tones by using pixel patterns (pixel patterns (D), (E), and (F) in FIG. 26) constituted by a plurality of dots at different landing positions. This makes it possible to suppress graininess due to coarse and dense portions. In this case, the two kinds of pixel patterns (D) and (E) corresponding to quantization level "3" may be regularly selected in accordance with the image printing position or the occurrence of data with quantization level "3". If, however, there is a factor that causes a deterioration in landing precision, they are preferably selected randomly. In this embodiment, tone reproduction may be realized by using the pixel patterns shown in FIG. 26 in this manner. Even in this case, as in the case wherein the pixel patterns in FIG. 22 are used, patterns of one kind having a dot arrangement that causes dots to land at the same position are used as pixel patterns corresponding to quantization levels "1" and "2" which are used to print a low gray level portion, whereas patterns each having a dot arrangement that causes dots to land at two or more different positions are used as pixel patterns corresponding to quantization levels "3" and "4" which are used to print a high gray level portion. With these patterns, the same effect as that described above can be obtained.

As described above, according to this embodiment, since patterns having dot arrangements which cause dots to land at the same position are used as pixel patterns corresponding to quantization levels "1" and "2" which are used to print a low gray level portion, graininess (noise) which is especially noticeable in a low gray level portion with a low quantization level can be reduced. In addition, in this embodiment, since patterns having dot arrangements that cause dots to land at two or more different positions are used as pixel patterns corresponding to quantization levels "3" and "4" which are used to print a high gray level portion, a sufficient area factor can be ensured, and a high gray level portion with a sufficient density can be formed.

[Sixth Embodiment]

In the fifth embodiment, pixel patterns having dot arrangements that cause dots to land at the same positions are used as pixel patterns corresponding to the lowest and second lowest gray level values (quantization levels 1 and 2), of a plurality of gray level values from which the gray level value (gray level 0=quantization level 0) corresponding to the lowest density (no dot) is excluded.

Even if the dot landing position in the pixel pattern corresponding to quantization level "1" does not coincide with that in the pixel pattern corresponding to quantization level "2", it suffices if the "barycenters" of the dots in the two pattern coincide with each other. That is, it suffices if the barycentric position of the dot in the pixel pattern corresponding to quantization level "1" coincides with that of the two dots in the pixel pattern corresponding to quantization level "21". For example, the pixel pattern (B) in FIG. 22 may be used for quantization level "1", and the pixel pattern (D) in FIG. 12 may be used for quantization level "2". The barycenter of the two dots in the pixel pattern (D) in FIG. 12 coincides with that of the dot in the pixel pattern (B) in FIG. 22.

Figure 21A:
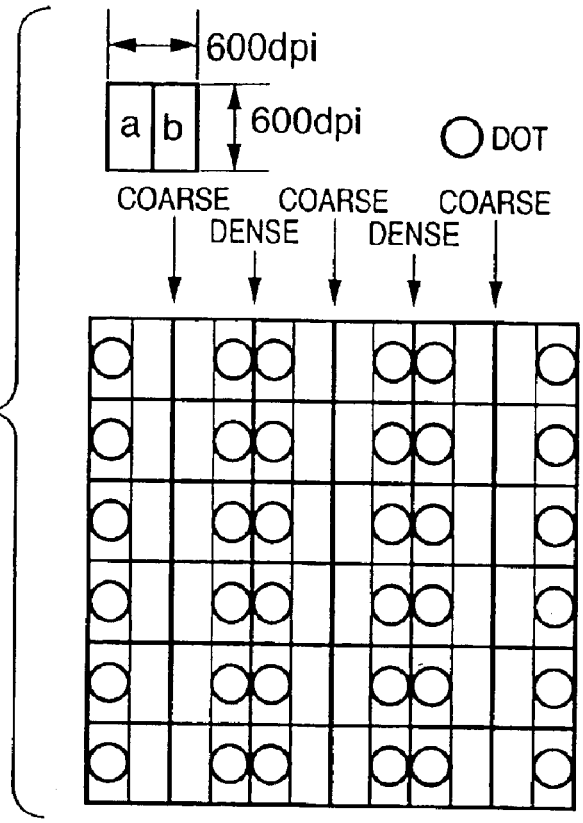
FIGS. 21A and 21B are views each for explaining a printed state that causes graininess.
Figure 21B:
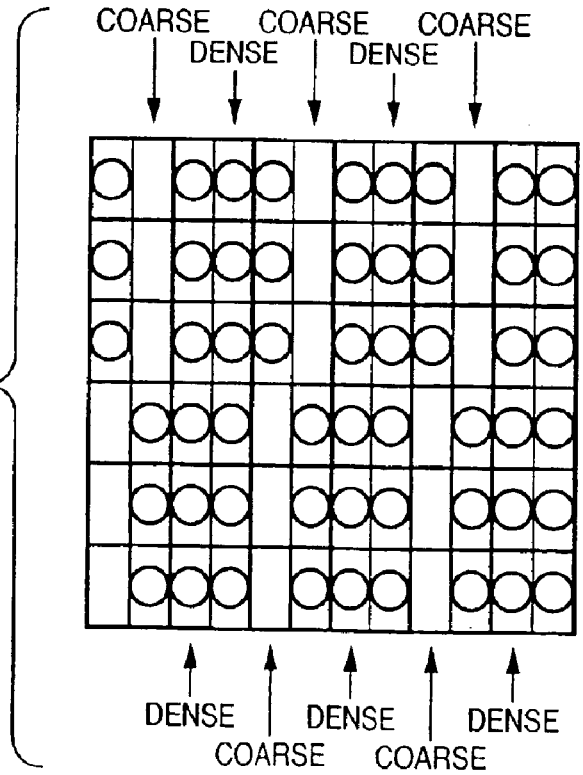

By using patterns whose dot barycenters coincide with each other as pixel patterns corresponding to quantization levels "1" and "2", variations in dot density like those shown in FIG. 21B can be prevented as in the case shown in FIG. 24B, thereby suppressing graininess (noise) due to coarse and dense portions.

[Seventh Embodiment]

The seventh embodiment of the present invention will be described below. A description of portions similar to those in the third and fifth embodiments will be omitted, and this embodiment will be described with particular emphasis on its characteristic feature.

This embodiment exemplifies the multipass printing method described in the third embodiment. Assume that the quantized pixel patterns in the seventh embodiment are the same as those shown in FIG. 12 and used in the third embodiment, and the mask patterns in the seventh embodiment are the same as those shown in FIG. 13 and used in the third embodiment.

The same printing operation as that shown in FIG. 14 and used in the third embodiment is basically used. However, the convey amount of printing medium and the printing position in a matrix are made to differ from those in the case shown in FIG. 14. More specifically, a printing medium is constantly conveyed by 4/600 inches, and data at the lower left position (b) and lower right position (d) in the (2×2) matrix in FIG. 12 are so printed as to be superimposed at the upper left position (a) and upper right position (c).

In this embodiment, the two kinds of patterns (B) and (C) in FIG. 12 are used as pixel patterns corresponding to quantization level "1". By executing the above printing operation, however, dots are printed at the same position (the position (a) in FIG. 12) in the matrix regardless of which one of the two kinds of patterns is used. In addition, a pattern having dots arranged at different positions like the pattern (D) in FIG. 12 is used as a pixel pattern corresponding to quantization level "2". By executing the above printing operation, however, these two dots are printed at the same position (the position (a) in FIG. 12) in the matrix.

In this embodiment, pixels with quantization levels "1" and "2" are so printed as to make the dot landing positions become the same in the end. Therefore, the same print result as that obtained with the dot arrangements (that cause no variation in density) in the fifth embodiment described above can be obtained, thus suppressing graininess (noise) due to coarse and dense portions like those shown in FIG. 21A or 21B.

As is obvious from the above description, in performing multipass printing by using pixel patterns like those shown in FIG. 12, pixels having the lowest and second lowest gray level values (quantization levels 1 and 2) are printed by landing dots at the same positions in the pixels, thereby obtaining the same dot arrangement as that in the fifth embodiment described above. This makes it possible to suppress graininess (noise) due to coarse and dense portions like those shown in FIG. 21A or 21B.

In this case, in the print result, the dot landing position in each pixel corresponding to quantization level 1 is made to coincide with that in each pixel corresponding to quantization level 2. However, the dot landing positions may differ from each other as long as the barycenters of the dots coincide with each other as described in the sixth embodiment. That is, it is suffices if the dot barycenter in each pixel corresponding to quantization level 1 coincides with that in each pixel corresponding to quantization level 2 in a print result.

This embodiment has exemplified the case wherein four gray level values are expressed by using the pixel patterns (pixel patterns in FIG. 12) for landing 0, one, two, and four dots with respect to pixels with 600×600 dpi. However, pixel patterns to be used to express four gray level values are not limited to them.

Figure 27:
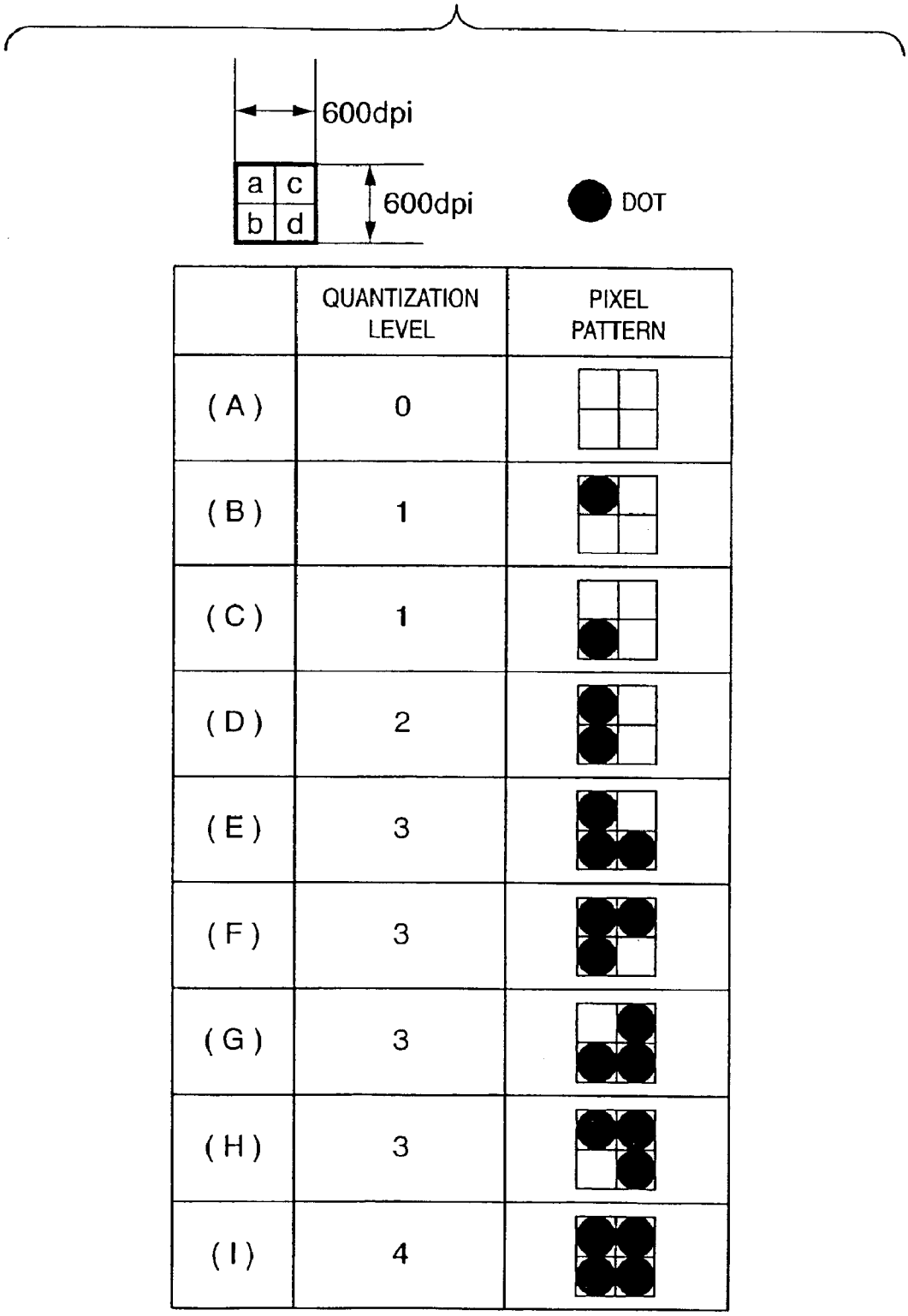
FIG. 27 is a view showing other quantization levels and pixel patterns according to the sixth embodiment of the present invention.

Four gray levels may be expressed by using pixel patterns corresponding to quantization levels "0" to "3" shown in FIG. 27. In this case, only up to three dots are caused to land even with respect to a pixel with the highest gray level value (a pixel corresponding to quantization level "3"). In this case, as pixel patterns corresponding to quantization level "3", pixel patterns (two kinds of pixel patterns (E) and (F) in FIG. 27) in each of which two dots overlap each other on the left side in the matrix and one dot is placed on the right side or pixel patterns (two kinds of pixel patterns (G) and (H) in FIG. 27) in each of which one dot is placed on the left side and two dots overlap each other on the right side may be used. Alternatively, all these four kinks of pixel patterns may be used. In this case, the two kinds of pixel patterns (E) and (F), the two kinds of pixel patterns (G) and (H), or the four kinds of pixel patterns (E) to (H) corresponding to quantization level "3" may be regularly selected in accordance with the image printing position or the occurrence of data with quantization level "3". If, however, there is a factor that causes a deterioration in landing precision, they are preferably selected randomly.

Note that in this form described above, as in the above case, the dot landing positions or dot barycenters in pixels respectively corresponding to quantization levels 1 and 2 are made to coincide with each other in the print result.

In another form wherein five gray level values are to be expressed by using pixel patterns ((A) to (I) in FIG. 27) corresponding to quantization levels "0" to "4" in FIG. 27 as well, graininess (noise) in a low gray level portion can be suppressed while a sufficient image density can be ensured in a high gray level portion by filling each matrix with dots, as in the above case wherein four gray levels are expressed.

Note that in this form described above, as in the above case, the dot landing positions or dot barycenters in pixels respectively corresponding to quantization levels 1 and 2 are made to coincide with each other in the print result.

As described above, according to this embodiment, pixels corresponding to the lowest and second lowest gray level values (gray levels 1 and 2), of a plurality of gray level values from which the gray level value (gray level 0=quantization level 0) corresponding to the lowest density (no dot) is excluded, are printed to reproduce tones such that the dot landing positions or dot barycenters in the respective pixels coincide with each other. On the other hand, pixels having higher gray level values (quantization levels 3 and 4) are printed to reproduce tones such that dots land at two more different positions. Therefore, graininess (noise) due to coarse and dense portions in a low gray level portion can be suppressed, while a sufficient area factor can be ensured in a high gray level portion, and an increase in density can be attained.

[Eighth Embodiment]

In the fifth, sixth, and seventh embodiments, pixels (first pixels) corresponding to the lowest and second lowest gray level values (quantization levels 1 and 2), of a plurality of gray level values from which the gray level value (gray level 0=quantization level 0) corresponding to the lowest density (no dot) is excluded, are so printed as to make the dot landing positions or dot barycenters in the first pixels become the same, whereas pixels (second pixels) corresponding to the third lowest or higher gray level values (quantization levels 3 and 4) are so printed as to land dots at two or more different positions.

In the present invention, however, the gray level values (quantization levels) at which printing is done such that the dot landing positions or dot barycenters in pixels coincide with each other are not limited to gray levels 1 and 2.

In the first example, in printing using five gray level values (gray levels 0 to 4), pixels (first pixels) corresponding to the lowest to third lowest gray level values (quantization levels 1 to 3), of a plurality of gray level values from which the gray level value (gray level 0=quantization level 0) corresponding to the lowest density (no dot) is excluded, may be so printed as to make the dot landing positions or dot barycenters in the first pixels coincide with each other, whereas pixels (second pixels) corresponding to the fourth lowest or higher gray level value (quantization level 4) may be so printed as to make the dot landing positions in the second pixels differ from each other.

In the second example, in printing using nine gray level values (gray levels 0 to 8), pixels (first pixels) corresponding to the lowest and second lowest gray level values (quantization levels 1 and 2), of a plurality of gray level values from which the gray level value (gray level 0=quantization level 0) corresponding to the lowest density (no dot) is excluded, may be so printed as to make the dot landing positions or dot barycenters in the first pixels coincide with each other, whereas pixels (second pixels) corresponding to the third lowest or higher gray level values (quantization levels 3 to 8) may be so printed as to make the dot landing positions in the second pixels differ from each other.

In the third example, in printing using nine gray levels (gray levels 0 to 8), pixels (first pixels) corresponding to the lowest to fourth lowest gray level values (quantization levels 1 to 4), of a plurality of gray level values from which the gray level value (gray level 0=quantization level 0) corresponding to the lowest density (no dot) is excluded, may be so printed as to make the dot landing positions or dot barycenters in the first pixels coincide with each other, whereas pixels (second pixels) corresponding to the fifth lowest or higher gray level values (quantization levels 5 to 8) may be so printed as to make the dot landing positions in the second pixels differ from each other.

In the fourth example, in printing using 16 gray level values (gray levels 0 to 15), pixels (first pixels) corresponding to the lowest and second lowest gray level values (quantization levels 1 and 2), of a plurality of gray level values from which the gray level value (gray level 0=quantization level 0) corresponding to the lowest density (no dot) is excluded, may be so printed as to make the dot landing positions or dot barycenters in the first pixels coincide with each other, whereas pixels (second pixels) corresponding to the third lowest or higher gray level values (quantization levels 3 to 15) may be so printed as to make the dot landing positions in the second pixels become two or more different positions.

In the fifth example, in printing using 16 gray level values (gray levels 0 to 15), pixels (first pixels) corresponding to the lowest to fifth lowest gray level values (quantization levels 1 to 5), of a plurality of gray level values from which the gray level value (gray level 0=quantization level 0) corresponding to the lowest density (no dot) is excluded, may be so printed as to make the dot landing positions or dot barycenters in the first pixels coincide with each other, whereas pixels (second pixels) corresponding to the sixth lowest or higher gray level values (quantization levels 6 to 15) may be so printed as to make the dot landing positions in the second pixels become two or more different positions.

Obviously, the numbers of gray levels which can be used in the present invention are not limited to the above values, i.e., four, five, nine, and 16.

As described above, according to the present invention, pixels (first pixels) belonging to "the first gray level value group" corresponding to at least the lowest and second lowest gray level values, of a plurality of gray level values from which the gray level value (gray level 0=quantization level 0) corresponding to the lowest density (no dot) is excluded, are so printed as to make the dot landing positions or dot barycenters in the first pixels coincide with each other, whereas pixels (second pixels) corresponding to gray level values higher than those of the first gray level value group are so printed as to make the dot landing positions in the second pixels exist at two or more positions.

As described above, according to this embodiment, since pixels belonging to "the first gray level value group" corresponding to at least the lowest and second lowest gray level values are so printed as to make the dot landing positions or dot barycenters in the pixels coincide with each other, a low gray level portion with reduced graininess (noise) can be formed. In addition, since pixels belonging to "the second gray level value group" corresponding to gray level values higher than those of the first gray level value group are so printed as to make the dot landing position in the pixels exist at two or more positions, a sufficient area factor can be ensured, and a high gray level portion with a sufficient density can be formed.

[Other Embodiment]

In the embodiments described above, multilevel input image data has a resolution of 600×600 dpi, each pixel is expressed by a 2-bit multilevel value, and a (2×2) dot matrix is used as the arrangement of a pixel pattern. However, the resolution need not be 600×600 dpi, each pixel may be multilevel data larger than 2-bit data, and one pixel may be formed by a matrix other than a (2×2) matrix, e.g., a (4×4) dot matrix. Even with these settings, the same effects as those in the above embodiments can be satisfactorily obtained.

In the above embodiments, a medium gray level pixel is expressed by a plurality of dots at different landing positions. However, a medium gray level pixel may be expressed by superimposing a plurality of dots at the same landing position. According to the printing method in this case, by setting all the convey amounts of a printing medium in FIGS. 10, 11, and 14 to a constant feed amount of 4/600 inches, the data at the lower left position (b) and lower right position (d) in the (2×2) matrix in FIGS. 8 and 12 can be superimposed at the upper left position (a) and lower right position (c). In addition, when the data at the upper right position (c) and lower right position (d) are to be printed, they can be superimposed at the upper left position (a) and lower left position (b) by starting scanning operation therefrom without a shift of 1,200 dpi.

In this case, a medium gray level image may be expressed by partially superimposing the image data of the (2×2) matrix like (2×1) and (1×2) instead of superimposing all the data like (1×1), and the data need not always be printed at the same positions as those indicated by the pixel pattern.

In each embodiment described above, the mask patterns are regarded as fixed patterns. However, random mask patterns may be used to prevent the occurrence of texture due to tuning with image data.

In the above embodiments, no specific reference is made on the size of ink droplet. However, in expressing a multilevel image with ink droplets of different sizes as well, a similar effect to that described above can be obtained by making the number of dot landing positions in a high gray level portion larger than that in a low gray level portion. In addition, in the above embodiments, no specific reference is made on the type of ink. However, in expressing a multilevel image with a combination of ink droplets of the same color with different densities as well, a similar effect to that described above can be obtained.

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal.

By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, not only an exchangeable chip type printhead, as described in the above embodiment, which can be electrically connected to the apparatus main unit and can receive an ink from the apparatus main unit upon being mounted on the apparatus main unit but also a cartridge type printhead in which an ink tank is integrally arranged on the printhead itself can be applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

The present invention can be applied to a system constituted by a plurality of devices (e.g., host computer, interface, reader, printer) or to an apparatus comprising a single device (e.g., copying machine, facsimile machine).

Further, the object of the present invention can also be achieved by providing a storage medium storing program codes for performing the aforesaid processes to a computer system or apparatus (e.g., a personal computer), reading the program codes, by a CPU or MPU of the computer system or apparatus, from the storage medium, then executing the program.

In this case, the program codes read from the storage medium realize the functions according to the embodiments, and the storage medium storing the program codes constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program codes.

Furthermore, besides aforesaid functions according to the above embodiments are realized by executing the program codes which are read by a computer, the present invention includes a case where an OS (operating system) or the like working on the computer performs a part or entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, CPU or the like contained in the function expansion card or unit performs a part or entire process in accordance with designations of the program codes and realizes functions of the above embodiments.

If the present invention is realized as a storage medium, program codes corresponding to the above mentioned tables (FIG. 16 to FIG. 19) are to be stored in the storage medium.

As many apparently widely different embodiments of the present invention can be made without departing from the spirit and scope thereof, it is to be understood that the invention is not limited to the specific embodiments thereof except as defined in the appended claims.

What is claimed is:

1. An ink-jet printing method of performing a plurality of main scanning operations of an ink-jet printhead for discharging ink with respect to the same print area and completing printing on the same print area by the plurality of main scanning operations, comprising:

the printing step of performing multilevel printing by changing the number of ink droplets discharged to each pixel in the plurality of main scanning operations, wherein in the printing step, multilevel printing is performed such that the number of scans performed to discharge ink droplets used to print a pixel with a low gray level value is made larger than the number of scans performed to discharge ink droplets used only to print a pixel with a high gray level value.

2. The method according to claim 1, wherein the ink droplets used to print the pixel with the low gray level value are also used to print a pixel with a high gray level value.

3. The method according to claim 1, wherein the number of scans performed to discharge ink droplets used to print the pixel with the low gray level value is made larger than the number of scans performed to discharge ink droplets used only to print the pixel with the high gray level value.

4. The method according to claim 1, wherein different mask patterns are used in the respective scans performed to discharge ink droplets used to print the pixel with the low gray level value.

5. The method according to claim 4, wherein the mask patterns used in the respective scans are complementary to each other, and the sum of ratios of areas printed with all the mask patterns is 100%.

6. The method according to claim 1, wherein scans to discharge ink droplets used only to print the pixel with the high gray level value are performed at substantially equal intervals in each scan.

7. The method according to claim 1, wherein a scan to discharge an ink droplet used to print the pixel with the low gray level value and a scan to discharge an ink droplet used only to print the pixel with the high gray level value are performed in different directions.

8. The method according to claim 7, wherein a scan to discharge an ink droplet used to print the pixel with the low gray level value and a scan to discharge an ink droplet used only to print the pixel with the high gray level value are alternately performed.

9. The method according to claim 1, wherein multilevel printing is performed by dividing each pixel into a predetermined number of areas, and using a pattern for designating an area to which an ink droplet is to be discharged in accordance with each gray level value.

10. The method according to claim 9, wherein the plurality of patterns are used for the same gray level value.

11. The method according to claim 1, wherein processing of converting each pixel to be printed into gray level value data is executed by a printer driver installed in a computer device which can be connected to the ink-jet printing apparatus.

12. A program for causing a computer to execute processing of controlling the number of main scanning operations performed in an ink-jet printing method of performing a plurality of main scanning operations of an ink-jet printhead for discharging ink with respect to the same print area and completing printing on the same print area by the plurality of main scanning operations, the program including a code for the step of controlling the number of main scanning operations in performing multilevel printing by changing the number of ink droplets discharged to each pixel such that the number of scans performed to discharge ink droplets used to print a pixel with a low gray level value is made larger than the number of scans performed to discharge ink droplets used only to print a pixel with a high gray level value.

13. A computer-readable storage medium storing a program for causing a computer to execute processing of controlling the number of main scanning operations performed in an ink-jet printing method of performing a plurality of main scanning operations of an ink-jet printhead for discharging ink with respect to the same print area and completing printing on the same print area by the plurality of main scanning operations, the program including a code for the step of controlling the number of main scanning operations in performing multilevel printing by changing the number of ink droplets discharged to each pixel such that the number of scans performed to discharge ink droplets used to print a pixel with a low gray level value is made larger than the number of scans performed to discharge ink droplets used only to print a pixel with a high gray level value.

14. An ink-jet printing apparatus for performing a plurality of main scanning operations of an ink-jet printhead for discharging ink with respect to the same print area and completing printing on the same print area by the plurality of main scanning operations, comprising:

control means for controlling the number of main scanning operations in performing multilevel printing by changing the number of ink droplets discharged to each pixel such that the number of scans performed to discharge ink droplets used to print a pixel with a low gray level value is made larger than the number of scans performed to discharge ink droplets used only to print a pixel with a high gray level value.

* * * * *

UNITED STATES PATENT AND TRADEMARK OFFICE

CERTIFICATE OF CORRECTION

PATENT NO. : 6,942,310 B2
APPLICATION NO. : 10/752488
DATED : September 13, 2005
INVENTOR(S) : Hidehiko Kanda et al.

It is certified that error appears in the above-identified patent and that said Letters Patent is hereby corrected as shown below:

COLUMN 10:

Line 21, “patters” should read --patterns--.

COLUMN 13:

Line 25, “patters” should read --patterns--.

COLUMN 15:

Line 55, “scan.,” should read --scan,--.

COLUMN 16:

Line 10, “level “31”” should read --level “3”--.

COLUMN 20:

Line 6, “level “21”” should read --level “2”--.

COLUMN 21:

Line 29, “kinks” should read --kinds--.

Signed and Sealed this

Eleventh Day of July, 2006

JON W. DUDAS
*Director of the United States Patent and Trademark Office*